US007104747B2

(12) United States Patent
Talken et al.

(10) Patent No.: US 7,104,747 B2
(45) **Date of Patent: *Sep. 12, 2006**

(54) LOAD CHANGE SAFETY SYSTEM

(75) Inventors: Daniel J. Talken, Lafayette, CA (US); Charles D. Rizzuti, Martinez, CA (US)

(73) Assignee: Geo M. Martin Company, Emeryville, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/292,848

(22) Filed: Dec. 1, 2005

(65) Prior Publication Data

US 2006/0078414 A1 Apr. 13, 2006

Related U.S. Application Data

(63) Continuation of application No. 10/686,235, filed on Oct. 14, 2003, now Pat. No. 6,986,635.

(51) Int. Cl.
*B65G 57/00* (2006.01)

(52) U.S. Cl. ..... 414/790; 414/793.8; 414/794.5; 414/794.6; 271/162; 271/201; 198/592

(58) Field of Classification Search ..... 414/790, 414/794.5, 793.8, 792.8, 793.6, 794.6; 198/801, 198/592, 809, 861.5; 271/3.15, 3.17, 3.18, 271/162, 214, 301
See application file for complete search history.

(56) References Cited

U.S. PATENT DOCUMENTS

| | | | |
|---|---|---|---|
| 2,660,432 | A | 11/1953 | Wilske et al. |
| 2,901,250 | A | 8/1959 | Martin |
| 3,938,674 | A | 2/1976 | Kroeze et al. |
| 4,006,831 | A | 2/1977 | Jimenez |
| 4,065,122 | A | 12/1977 | Rejai |
| 4,188,861 | A | 2/1980 | Kroeze et al. |
| 4,265,443 | A | 5/1981 | Berthelot |
| 5,026,249 | A | 6/1991 | Shill |
| 5,028,201 | A | 7/1991 | Hawthorne |
| 5,205,704 | A | 4/1993 | Frost et al. |
| 5,325,953 | A | 7/1994 | Doster et al. |
| 5,439,209 | A | 8/1995 | Runzi |
| 5,605,433 | A | 2/1997 | Tanaka |
| 5,807,055 | A | 9/1998 | van de Hazel |

(Continued)

OTHER PUBLICATIONS

Drawing for Light Guard System for the Geo. M. Martin Upstacking Sheet Stacker, approximately 1990, Figures 1 and 2.

(Continued)

*Primary Examiner*—Douglas A. Hess
(74) *Attorney, Agent, or Firm*—James R. Cypher; Law Offices of James R. Cypher

(57) ABSTRACT

A load change safety system in which a sheet stacker having a stacking deck formed with a discharge end discharges sheet material onto and builds a sheet stack on a conveying sheet stack removal system formed with a receiving means. A variable pinch point gap is formed by relative motion between the discharge end of the stacking deck and the receiving means of the conveying sheet material removal system. The safety system includes redundant means selectively preventing a decrease in the variable pinch point gap. The redundant means of the safety system preferably includes an electro-optical light guard means operably connected to the redundant means with one or more redirections of light beams to create a light guard perimeter guarding portions of the stacker and sheet removal system to guard against access to the pinch point.

23 Claims, 40 Drawing Sheets

U.S. PATENT DOCUMENTS

| | | | | |
|---|---|---|---|---|
| 5,904,465 | A * | 5/1999 | Villacieros Fernandez | 414/794.5 |
| 5,913,655 | A * | 6/1999 | Maday | 414/797.2 |
| 5,980,196 | A | 11/1999 | Roth | |
| 6,042,108 | A | 3/2000 | Morgan et al. | |
| 6,053,695 | A | 4/2000 | Longoria et al. | |
| 6,234,473 | B1 | 5/2001 | Morgan et al. | |
| 6,427,999 | B1 | 8/2002 | Christofferson | |
| 6,497,549 | B1 * | 12/2002 | Brown | 414/790.3 |
| 6,557,846 | B1 | 5/2003 | Martin et al. | |
| 6,769,862 | B1 | 8/2004 | Kuhl | |
| 6,776,572 | B1 | 8/2004 | Reist | |
| 6,986,635 | B1 * | 1/2006 | Talken et al. | 414/790 |

OTHER PUBLICATIONS

Drawing for Light Guard System for the Geo. M. Martin Upstacking Sheet Stacker, approximately 1990, Figures 3 and 4.

* cited by examiner

LOAD CHANGE SAFETY SYSTEM

This application is a continuation of application Ser. No. 10/686,235, filed Oct. 14, 2003, now U.S. Pat. No. 6,986, 635 granted Jan. 17, 2006.

BACKGROUND OF THE INVENTION

This invention relates to a system designed to keep the operator 30 and/or other individuals safe from the hazardous condition of a lowering stacking deck 3,3' of a sheet stacker 2,2'. The hazardous condition is the variable pinch point gap 9,9' created between the discharge end 4,4' of the stacking deck 3,3' and a conveying sheet material removal system 7,7' typically located under the discharge end 4,4' of the sheet stacker 2,2'. The conveyor system provides means for transporting material away from the sheet stacker 2,2'. The need for the load change safety system 1-1"" is amplified by the fact that the operator 30 and/or other individuals are required to frequently go near the hazardous area of the variable pinch point gap 9,9' during normal production operation to place protective sheets, referred to as dunnage 50 and/or pallets 51 on the conveying sheet material removal system 7,7' before each sheet stack 6 is created at the discharge end 4,4' of the sheet stacker 2,2'.

The term operator 30 used throughout this patent shall be interpreted to include not only the person operating the sheet stacker 2,2' but also any and all other people that come near or in contact with the sheet stacker.

The term LCS system is used in this patent to refer to the Load Change Safety System.

It is common to stack cardboard/corrugated sheet stacks 6 into full stacks 52, which are then conveyed in a straight line by a floor conveyor (typically top of conveyor rollers approximately 12 inches above the floor) to another machine. These full stacks 52 are often created by first placing down a pallet 51 and/or a protective sheet on said sheet material removal system 7,7'. These protective sheets are often referred to as dunnage 50 in the industry. The pallet 51 and/or dunnage 50 provides protection for the bottom sheets of the full stacks 52 and/or allow machinery down stream (typically fork lift trucks) to be able to handle the full stacks 52.

One form of sheet stacker 2 found in U.S. Pat. No. 2,901,250 granted to Martin on Aug. 25, 1959. The sheet stacker is typical of a class of stackers referred to as "upstackers" in the industry since they create a full stack 52 by using a stacking deck 3 which articulates in such a way that the receiving end has little or no vertical motion and the discharge end 4 has adequate motion to create full stacks 52 while moving in a generally upward motion. The cardboard/corrugated is transported on a plurality of conveyor belts built into the stacking deck 3 from the receiving end of the stacking deck 3 to the discharge end 4 of the stacking deck 3.

A second form of sheet stacker is found in U.S. Pat. No. 5,026,249 granted to TEI on Jun. 25, 1991. The sheet stacker is typical of a class of stackers referred to as a "downstackers" in the industry since they create a full stack 52 by elevating and lowering the sheet material removal system 7' under a fixed stacking deck in such a way that the receiving end and discharge end of a stacking deck has no motion but the elevating conveyor lowers as the sheet stack 6 is created in order to create full stacks 52.

A third form of sheet stacker is a hybrid where both the stacking deck 2 and sheet material removal system 7' can move in their prescribed motion in order to create the sheet stacks 6.

It is also common to stack cardboard/corrugated sheets into short sheet stacks 6 referred to as bundles in the industry. The bundles are typically created at the discharge end 4,4' of the sheet stacker 2,2' on some sort of conveyor roller or conveyor belt system, which is typically referred to as a bundle takeaway system. Typical bundle takeaway systems are waist high in order to allow the operator to manually manipulate the bundles down stream.

In both situations where full stacks 52 or bundles are being created, the sheets are stacked during the motion by which the variable pinch point gap 9,9' between the discharge end 4,4' of the stacking deck 3,3' is increasing. Once a full stack 52 or bundle has been created, it must be transported from under the discharge end 4,4' of the sheet stacker 2,2'. While the full stack(s) 52 or bundle(s) is being transported, an accumulation device 54 is often employed to collect sheet material 5 so as to allow material to continue to fall off the end of the stacking deck 3,3' while waiting for the full stack 52 or bundle to be transported and allowing the stacking deck 3,3' and/or sheet material removal system 7,7' to move towards each other, thus decreasing the variable pinch point gap 9,9'. One form of accumulation device 54 is found in U.S. Pat. No. 6,042,108, Morgan et al, granted Mar. 28, 2000. The variable pinch point gap must decrease in a relatively fast motion approximately 4–5 seconds on full stacks 52 and 1–2 seconds on bundles in order to keep the material collecting in the accumulator area 55 from exceeding the designed capacity of the accumulation device 54. The ejecting of a sheet stack and reduction of variable pinch point gap 9,9' so next sheet stack can be built is commonly referred to as the load change cycle 56 in the industry.

This rapid motion of the stacking deck 3 and/or sheet material removal system 7' to within close proximity results in a hazardous condition where the variable pinch point gap 9,9' is formed between the bottom side of the discharge end 4,4' of the stacking deck 3,3' and the sheet material removal system floor conveyor or bundle takeaway system. Due to the weight and strength of the machinery, a person caught in this variable pinch point gap 9,9' may have the result of serious injuries or death.

The open design of the stacking deck 3,3' is a major productivity advantage of the sheet stacker 2,2'. During normal production it is important that the operator 50 have easy access to the discharge end 4,4' of the stacking deck 3,3'. This invention targets the production operations performed by the operator. The production operations includes setting up the order, running the order, adjusting the order, checking for quality control purposes, placing dunnage 50 and/or pallets 51, clearing jams and placing stack identification tags into full stacks 52. While executing production operations the operator must be able to have access to the discharge end 4,4' of the stacking deck 3,3' without completely de-energizing and re-energizing the machinery since this would have a substantial impact on production.

The maintenance/clean up operations performed by the operator 30 and other employees is a different type of operation. Unlike the production operation where one individual is responsible for the area around the discharge end 4,4' of the stacking deck 3,3', the maintenance/clean up operations may involve one or more people sometimes working on key systems including the hydraulic, pneumatic and electrical systems. Most companies owning sheet stacking machinery have already established procedures, commonly referred to as Zero Energy State and/or Lock-Out-Tag-Out. These procedures require too much recovery time to use as a safety solution during production operations.

The ability of the stacking deck 3 and/or sheet material removal system 7' to be able to execute a load change cycle 56 fully automatically without the assistance of the operator is often a required productivity feature of a sheet stacker 2,2'. Prior to this invention, some sheet stacker 2,2' owners have elected to eliminate the ability of the operator to execute a load change cycle 56 fully automatically. These sheet stackers 2,2' may require the operator to manually initiate the stacking deck 3,3' down motion or to depress some sort of push button during the entire time the variable pinch point gap 9,9' is decreasing. Even if this does not hinder the productivity due to the configuration of the sheet stacker 2,2' production line, this solution still may not meet the guidelines of the International Safety Standards which include redundancy and self-testing.

A light guard system for this type of sheet stacker 2,2' has been available since 1990 as provided by the Geo. M. Martin Co., see FIG. 1–4. However, this system has many short comings including 1) lack of a fail-safe mode should a single component fail, 2) no self testing, 3) difficult installation and maintenance due to stringent mirror alignment requirements, 4) lack of flexibility when needing multiple mirrors to reflect the light, 5) no fault detection of cross talk from external optical sources, 6) interference due to light stand locations and 7) not able to run fully automatic cycling of full stacks 52 when the sheet stacker 2,2' is equipped with an automatic dunnage 50 and/or pallet 51 system.

BRIEF SUMMARY OF THE INVENTION

The Load Change Safety System 1–1'''' of the present invention is a safety system to keep the operator 30 a safe distance from the variable pinch point gap 9,9' while the sheet stacker 2,2' is performing the load change cycle 56, hence achieving the very important objective of keeping the operator 30 from accidentally getting near or in the variable pinch point gap 9,9' while decreasing.

Another objective of the present invention is to provide hydraulic redundancy by including a rigid stacking deck 3 with dual cylinders 11,12, dual hydraulic lock valves 13,14 so that a single component failure in the hydraulic system will not allow the stacking deck 3 to initiate or continue the deck down cycle.

A further objective of the present invention is to provide the ability to perform self-testing on the hydraulic system by adding feedback sensors 18,19 to allow detection of a hydraulic leak and/or failure.

A further objective of the present invention is to provide a robust light guard system 27 by using a series of optical repeating nodes 24 instead of mirrors to reduce the requirements for precise alignment and the accumulation of accuracy error when needing to create a light guard perimeter 21 in which the beam(s) of light must be redirected multiple times. This light guard system 27 may be operatively connected to the LCS system control means 15'',15''' and the hydraulic lock valves 13,14 to place both valves in a state which does not allow the variable pinch point gap 9,9' to decrease.

A further objective of the present invention is to define a configuration of a light guard system 27 by which the optical repeating node 24' on the operator side of the sheet stacker 2,2' near the discharge end 4,4' of the stacking deck 3,3' is part of a movable remote control mean 35 in order to reduce the interference that would be caused if a floor mounted optical repeating node 24 was located in the same general proximity.

A further objective of the present invention is to modulate optical signals on the light beams 20,20' of the light guard system 27 in order to substantially increase the likelihood that any failure in the electrical and/or optical circuit is interpreted as a light guard system 27 intrusion and results in a fail-safe mode.

A further objective of the present invention is to configure the relationship between the sheet stacker 2,2', sheet material removal system 7, 7' and the location where the light guard perimeter 21 crosses over the sheet material removal system 7,7' in such a manner to allow synchronized discharge of the full stacks 52 and fully automatic completion of the load change cycle 56.

DETAILED DESCRIPTION OF THE INVENTION

Figure 1:
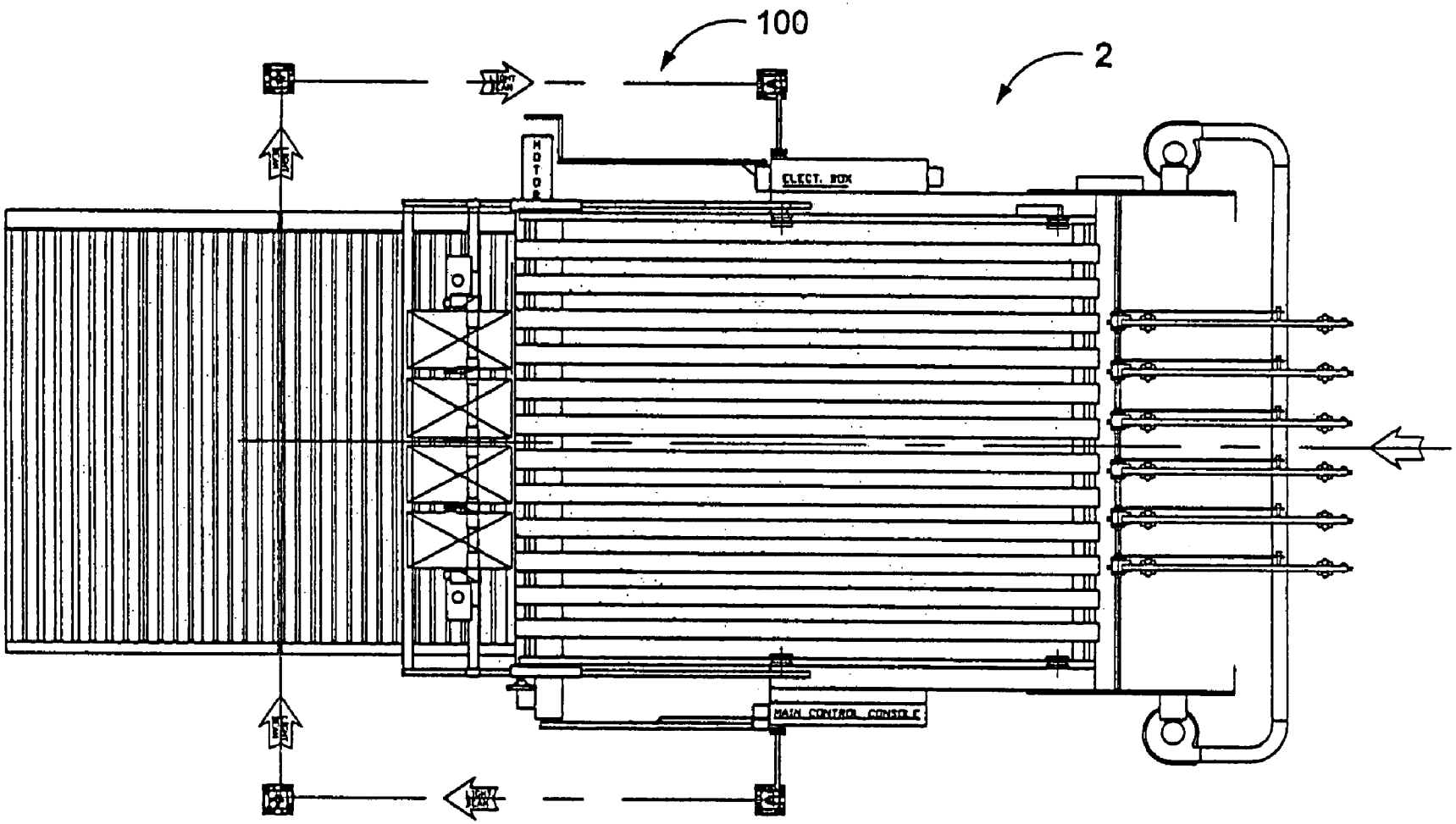
Figure 1 (Prior Art)
FIG. 1 is a prior art plan layout of a safety light beam system 100 provide by Geo. M. Martin Co. around 1990 for an upstacking sheet stacker 2.
Figure 2:
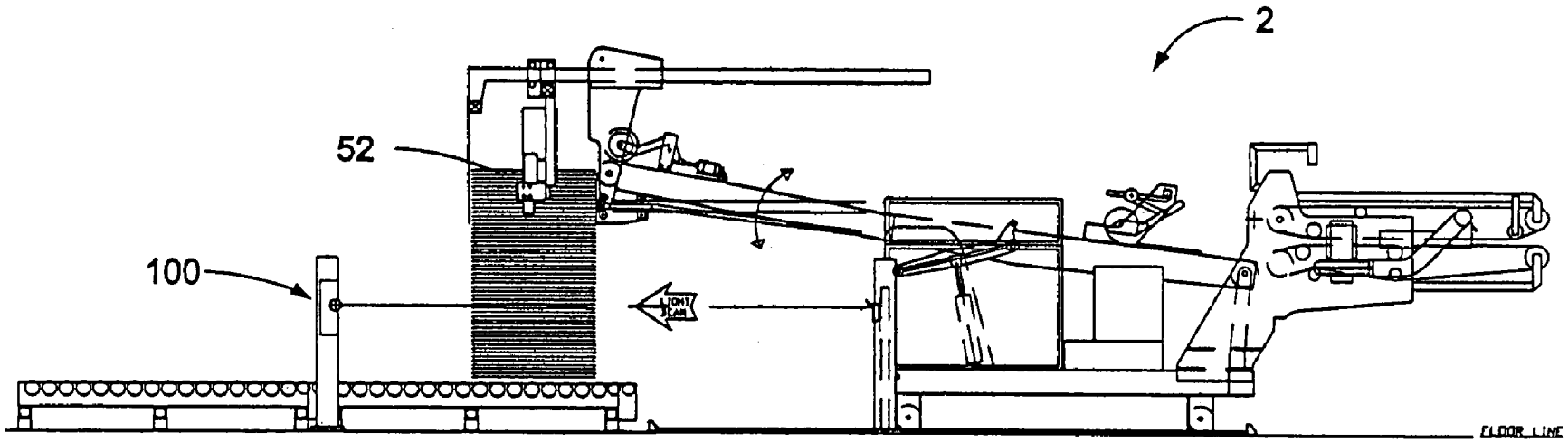
Figure 2 (Prior Art)
FIG. 2 is a side view of FIG. 1.
Figure 3:
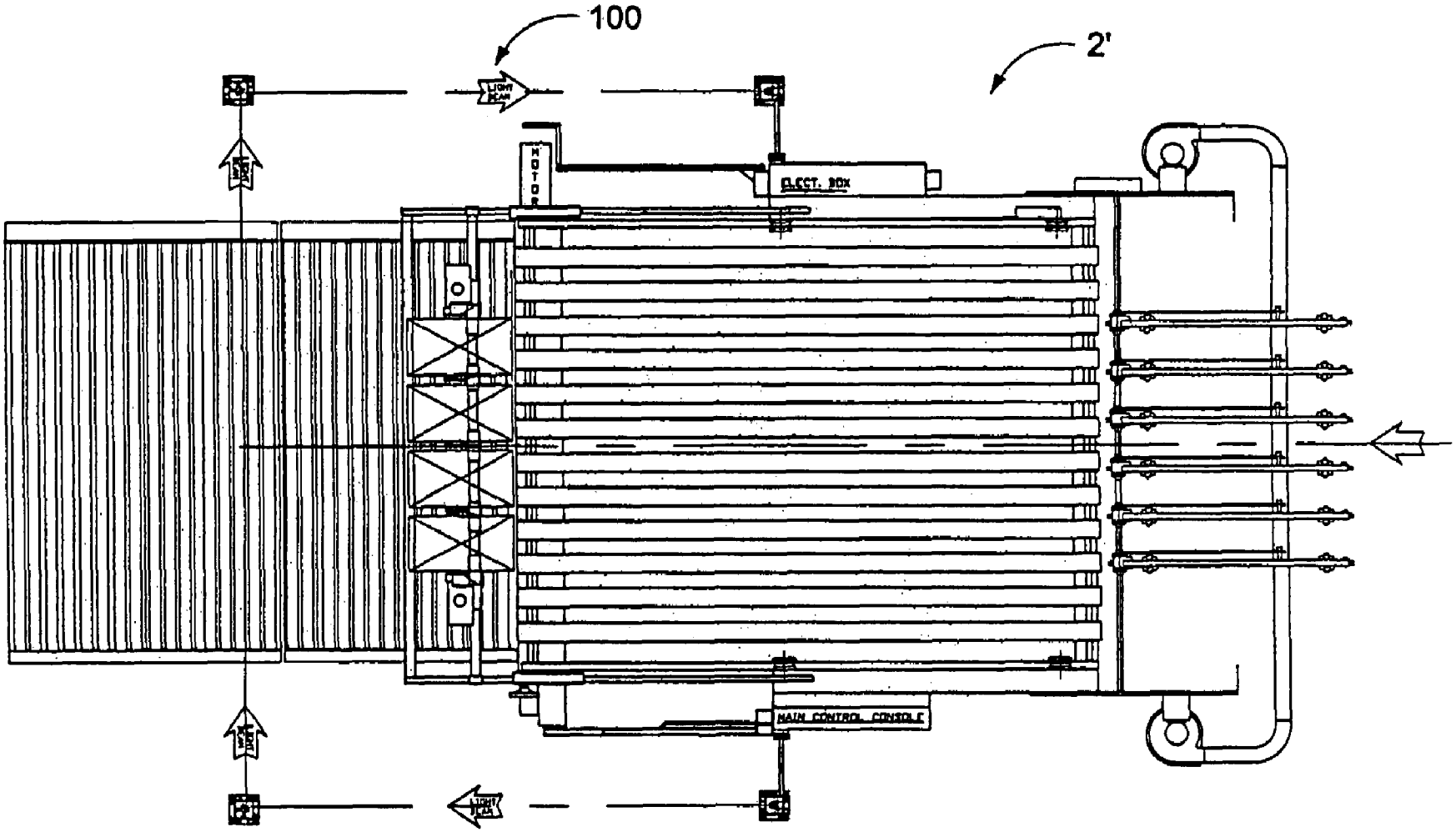
Figure 3 (Prior Art)
FIG. 3 is a prior art plan layout of a safety light beam system 100 provided by Geo. M. Martin Co. around 1990 for a downstacking sheet stacker 2'.
Figure 4:
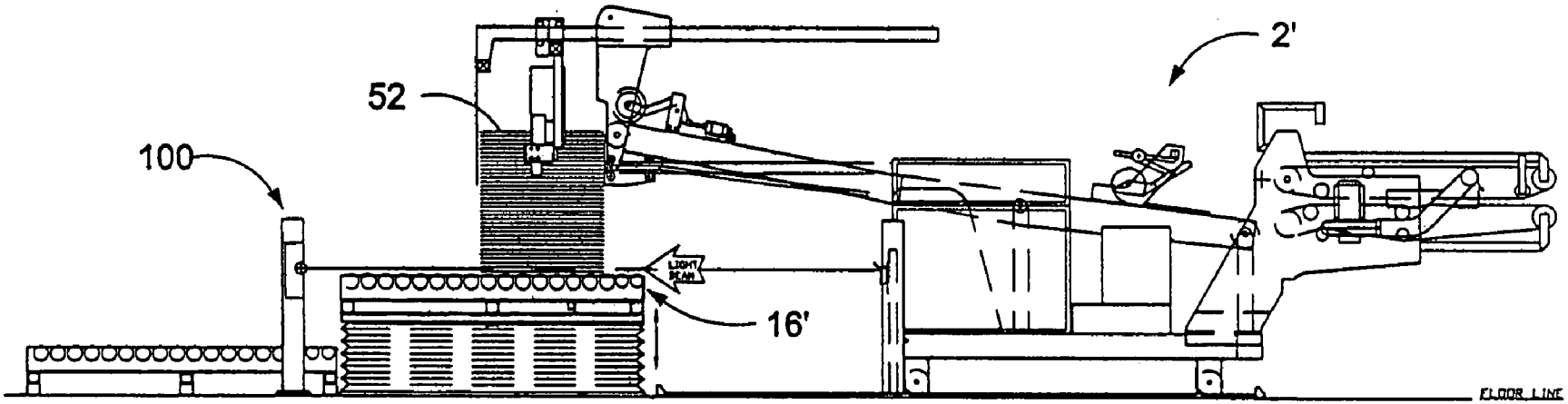
Figure 4 (Prior Art)
FIG. 4 is a side view of FIG. 3.
Figure 5:
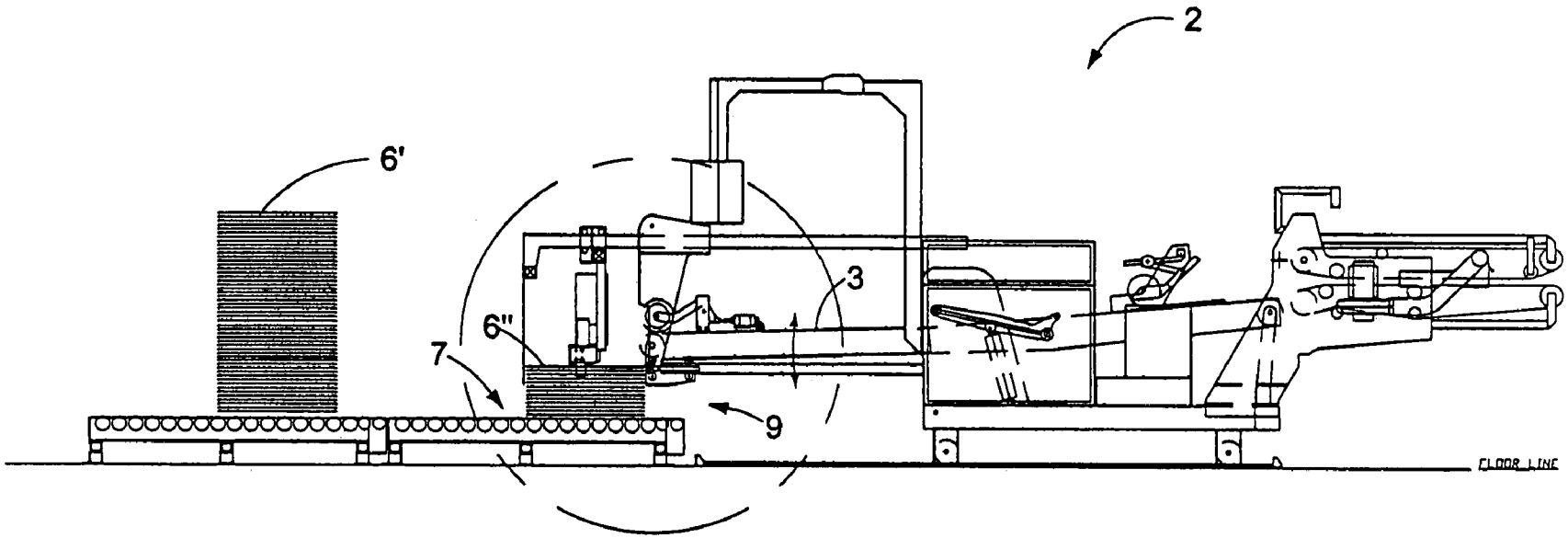
FIG. 5 shows a variable pinch point gap 9 for an upstacking sheet stacker 2 of the present invention with a substantial pinch point gap.

In the present invention, a load change safety system 1–1'" is provided for a sheet stacker 2,2' in which a variable pinch point gap 9,9' is created during the load change cycle 56 due to the motion of the stacking deck 3,3' and/or the conveying sheet material removal system 7,7'. The variable pinch point gap 9 can be created with an "upstacker" type of sheet stacker 2 where the stacking deck 3 moves in a generally upward direction, while the conveying sheet removal system 7 remains fixed, as illustrated in FIGS. 5, 6, 7 & 8. Alternatively, the variable pinch point gap 9' can be created with a "downstacker" type of sheet stacker 2' where the stacking deck 3' remains fixed, while the conveying sheet removal system moves in a generally downward direction, as illustrated in FIGS. 9,10,11 & 12.

The sheet stacks 6 are first created as the sheet material 5 exits the discharge end 4,4' of the stacking deck 3,3' and the variable pinch point gap 9,9' increases. This increase in said variable pinch point gap keeps the relative distance between the elevation at which the sheet material 5 exits the discharge end 4,4' of the stacking deck 3,3' and top of the sheet stack 6 approximately the same while the height of the sheet stack 6 increases. Once the sheet stack 6 has been created, it is necessary to perform a load change cycle 56.

Figure 13:
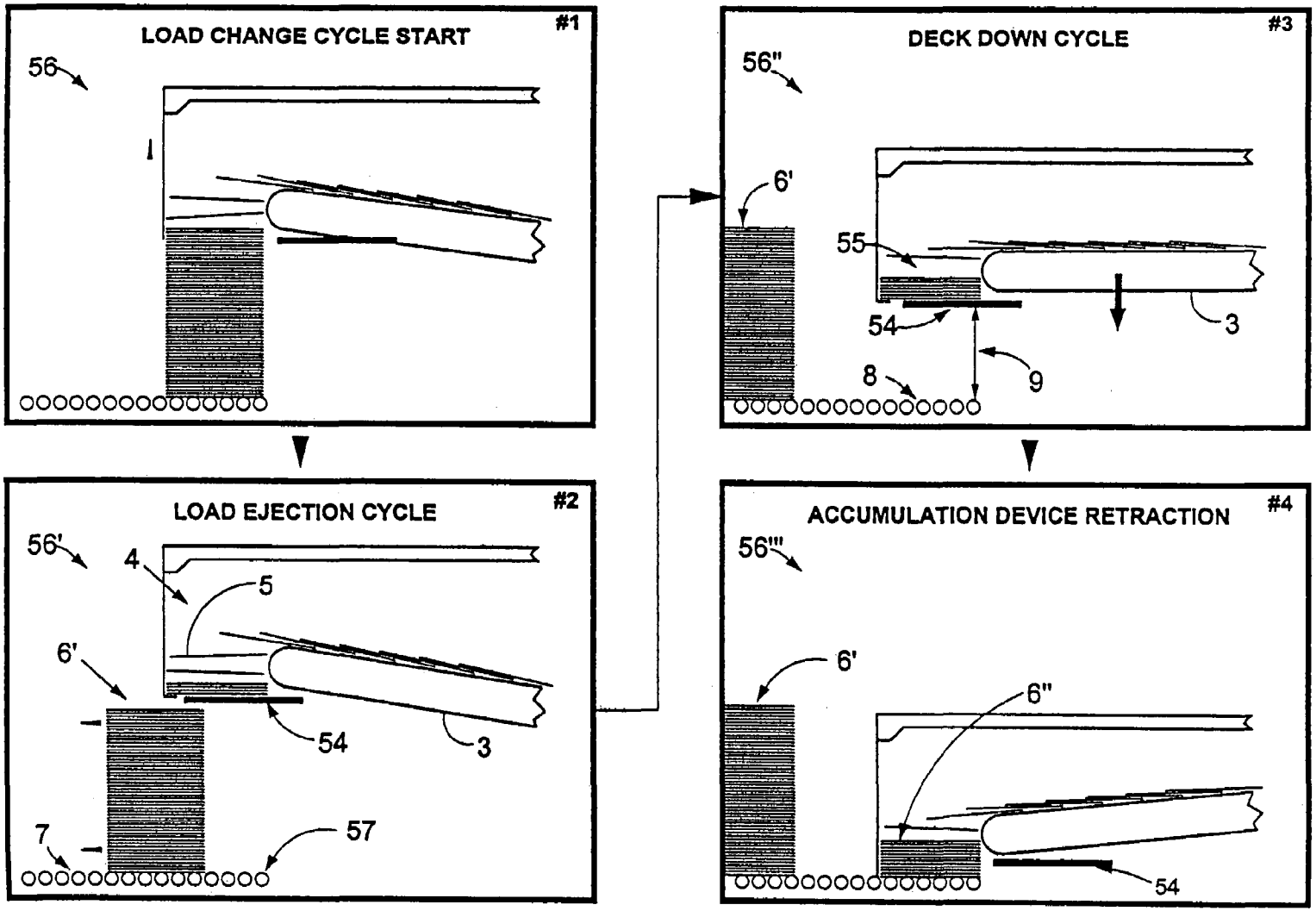
FIG. 13 is a sequence of cycles that create the load change cycle 56 for the upstacking sheet stacker 2 shown in FIG. 5.

The load change cycle 56, illustrated in FIG. 13 first requires load ejection cycle 56' in which the sheet stack 6' is transported downstream on the conveying sheet material removal system 7,7' using rollers 57 or belts. Often, during this period an accumulation device 54 is used to allow the sheet material 5 to continue to exit the discharge end 4,4' and the stacking deck 3,3'. After the load ejection cycle 56' is the deck down cycle 56" in which the variable pinch point gap 9,9' is decreased by motion of the stacking deck 3 down and/or motion of the conveying sheet material removal system 7' up. Once the deck down cycle 56" is completed, the accumulation device 54 retracts transferring the beginning of the next sheet stack 6" from the accumulation area 55 to the receiving means 8,8' of the conveying sheet material removal system 7,7'.

Figure 17:
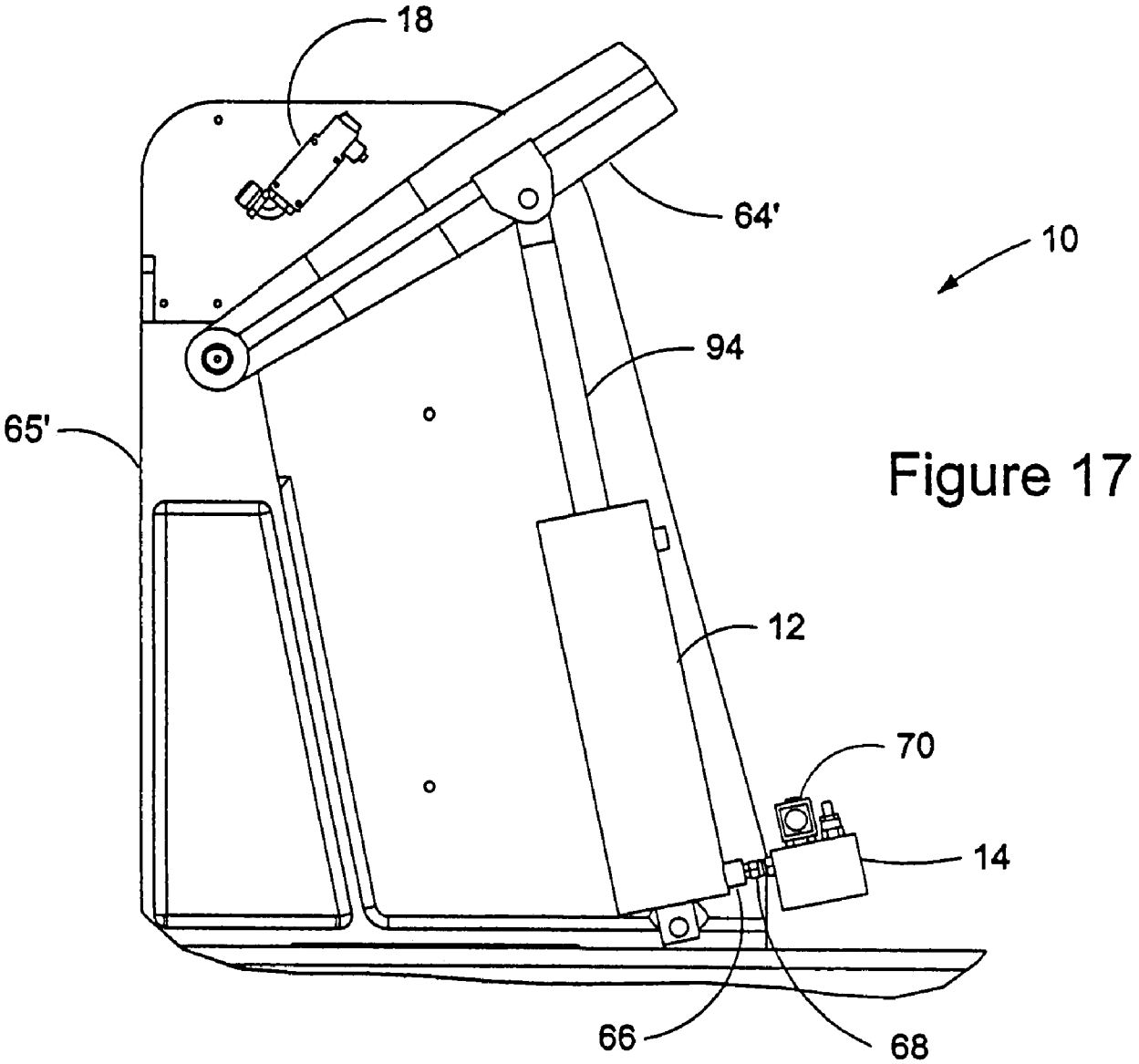
FIG. 17 is a zoomed in view of a portion of FIG. 16
Figure 18:
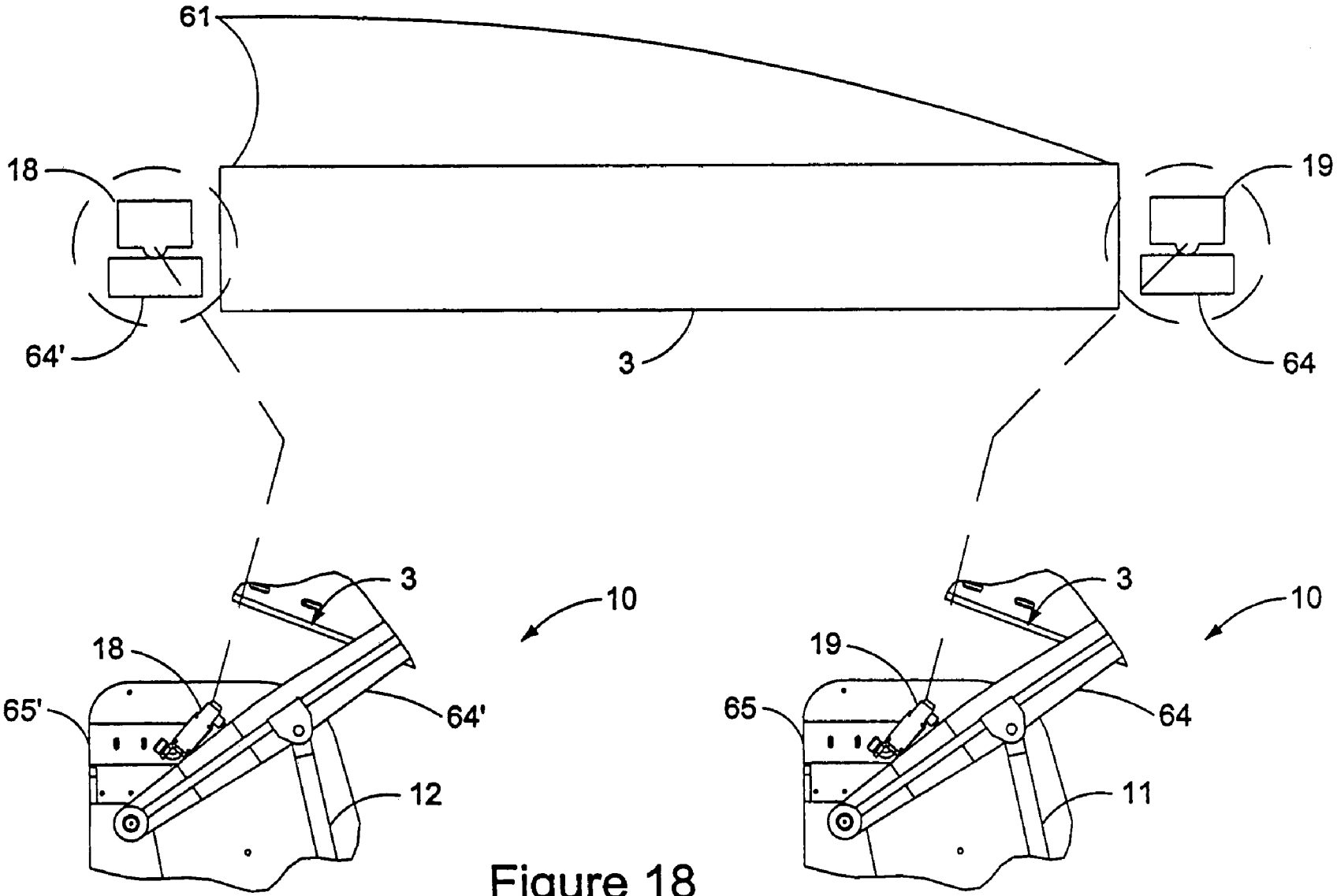
FIG. 18 is a schematic cross sectional view of FIG. 15 taken along line 18—18 when both cylinders 11.12 are providing support to stacking deck 3 activating hydraulic self testing limit switches 18,19.
Figure 19:
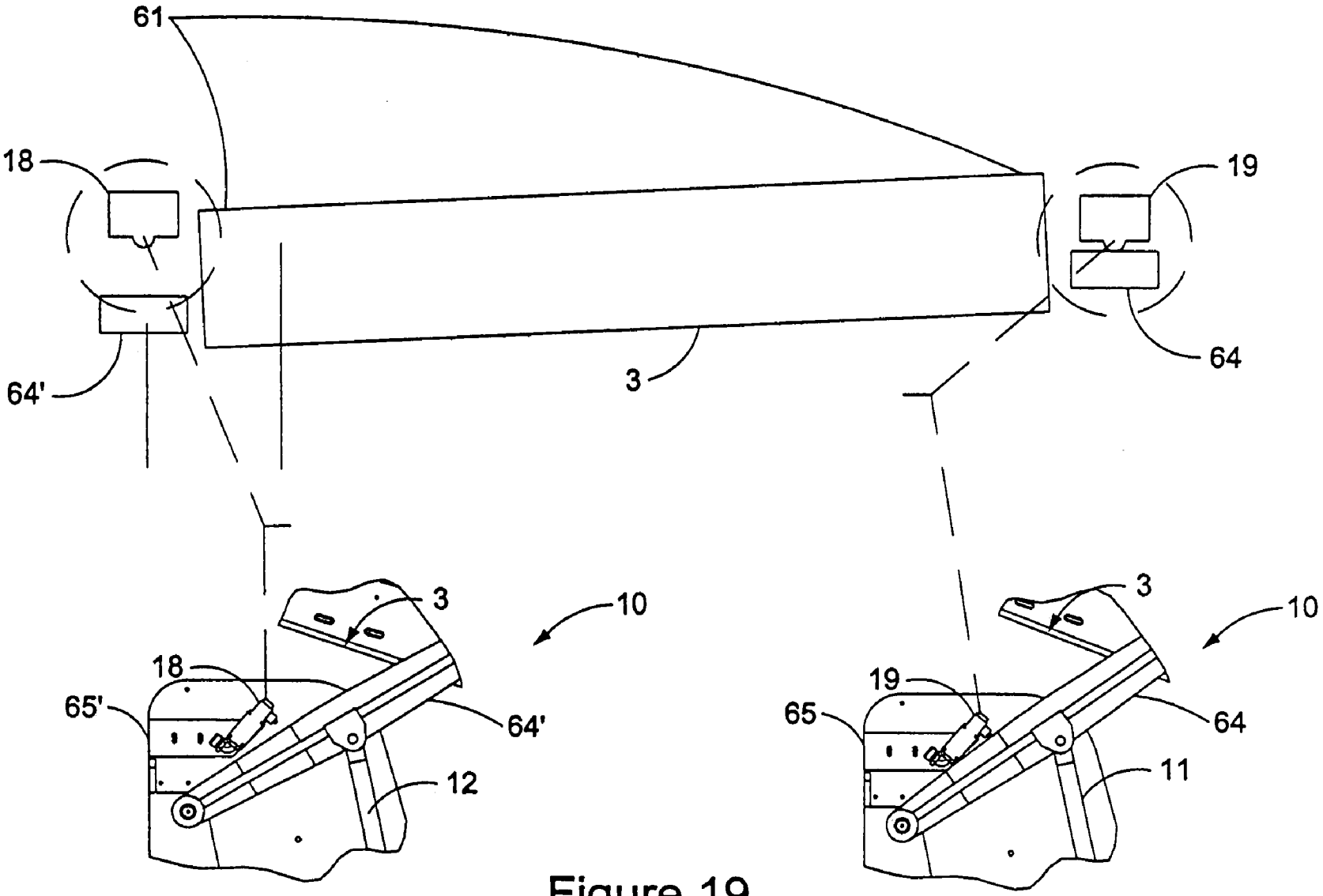
FIG. 19 is a schematic cross sectional view of FIG. 15 taken along line 18—18 when stacking deck 3 is in a different position and only one cylinder 11 is providing support to stacking deck 3 activating only one hydraulic self testing limit switch 19 showing the 'racking effect' of the substantially rigid stacking deck 3.
Figure 20:
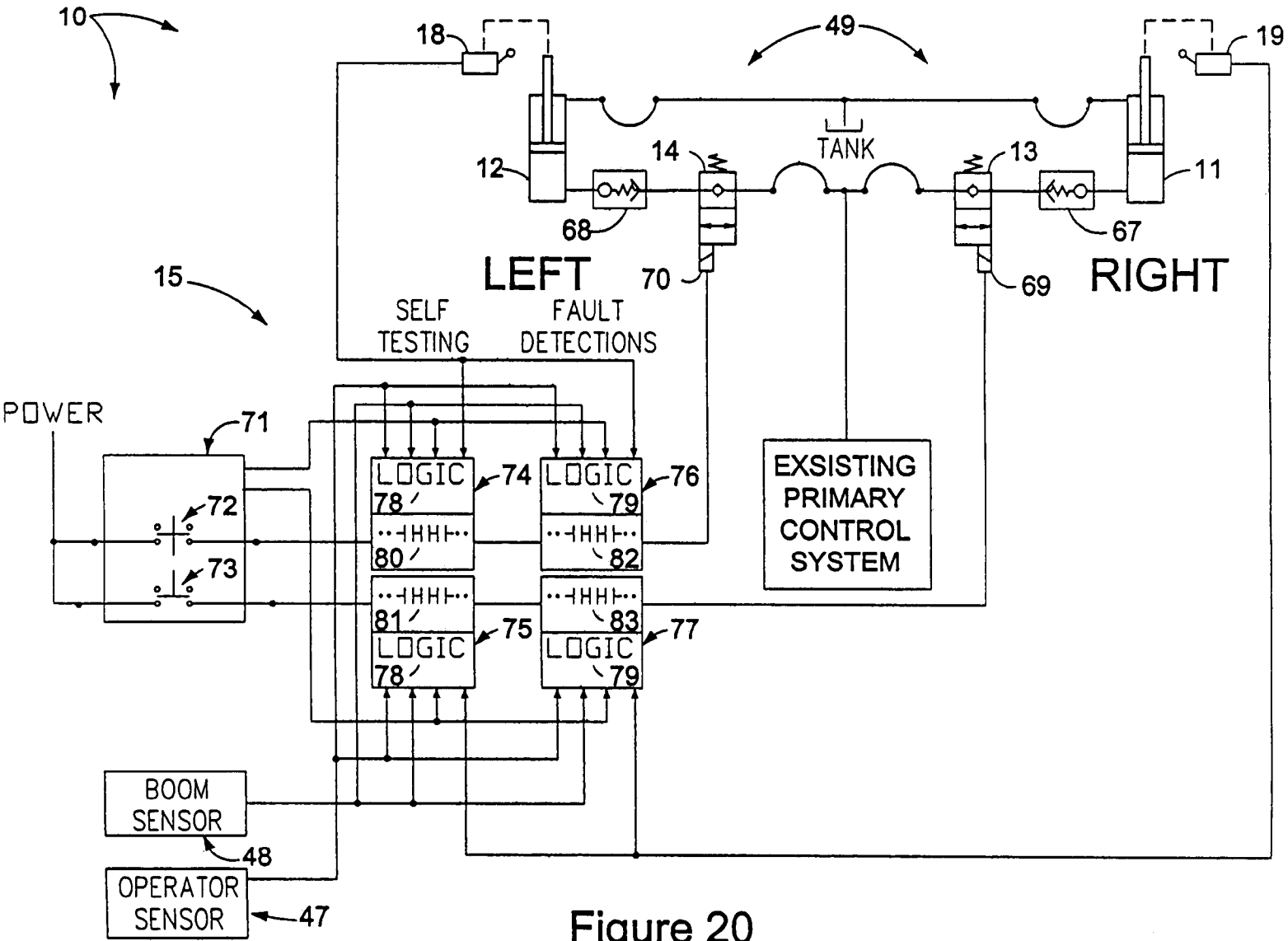
FIG. 20 is basic LCS system control means 15 hydraulic and electrical schematic for an upstacking sheet stacker 2

In the present invention, redundant means 10 including, e.g., hydraulic cylinders 11, 12, valves 13, 14 and LCS system control means 15 as shown in FIGS. 17, 18, and 20, are provided to selectively prevent the decrease of the variable pinch point gap 9,9' to reduce the chances of an operator 30 being hurt.

Figure 6:
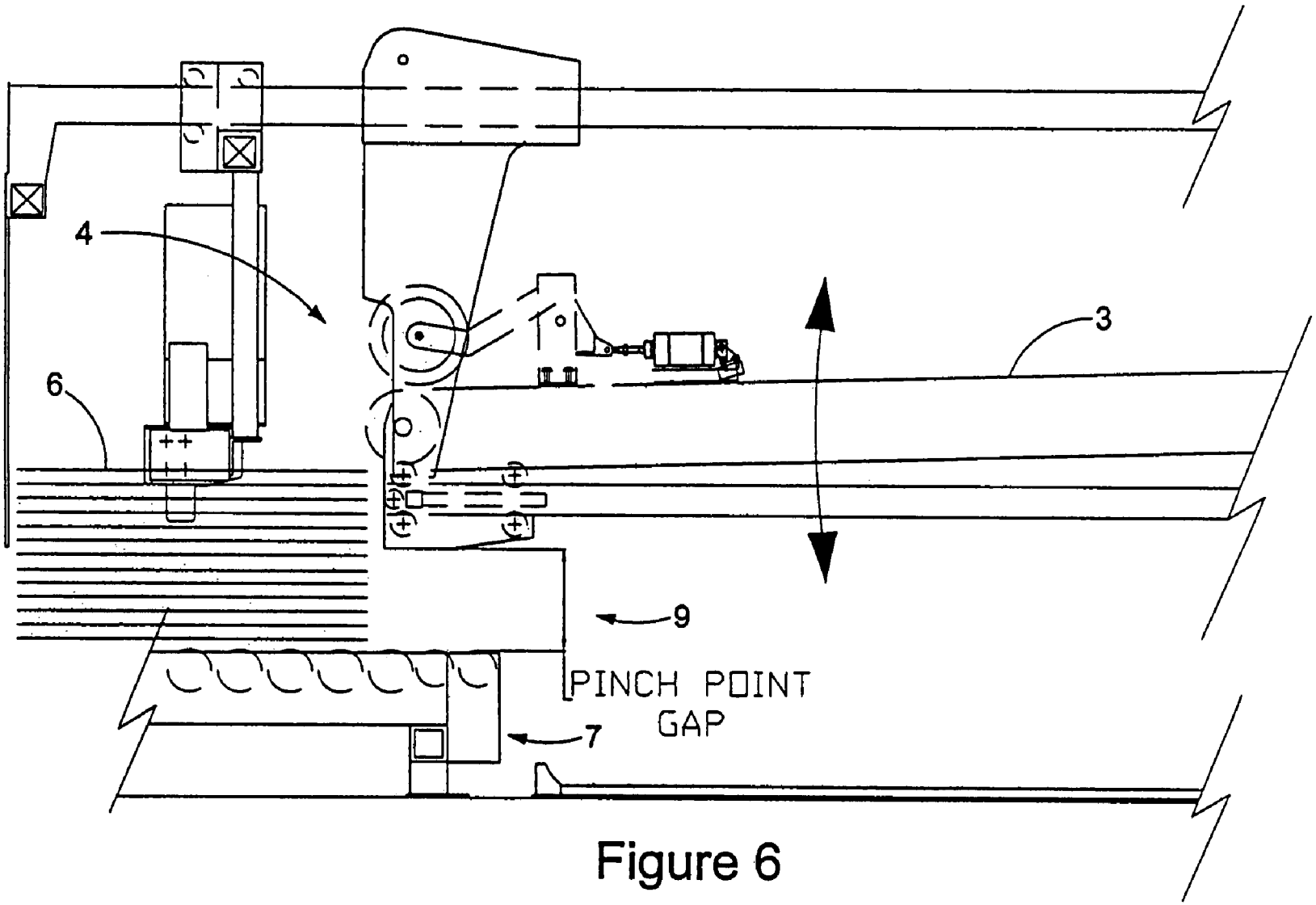
FIG. 6 is a zoomed in view of FIG. 5.
Figure 7:
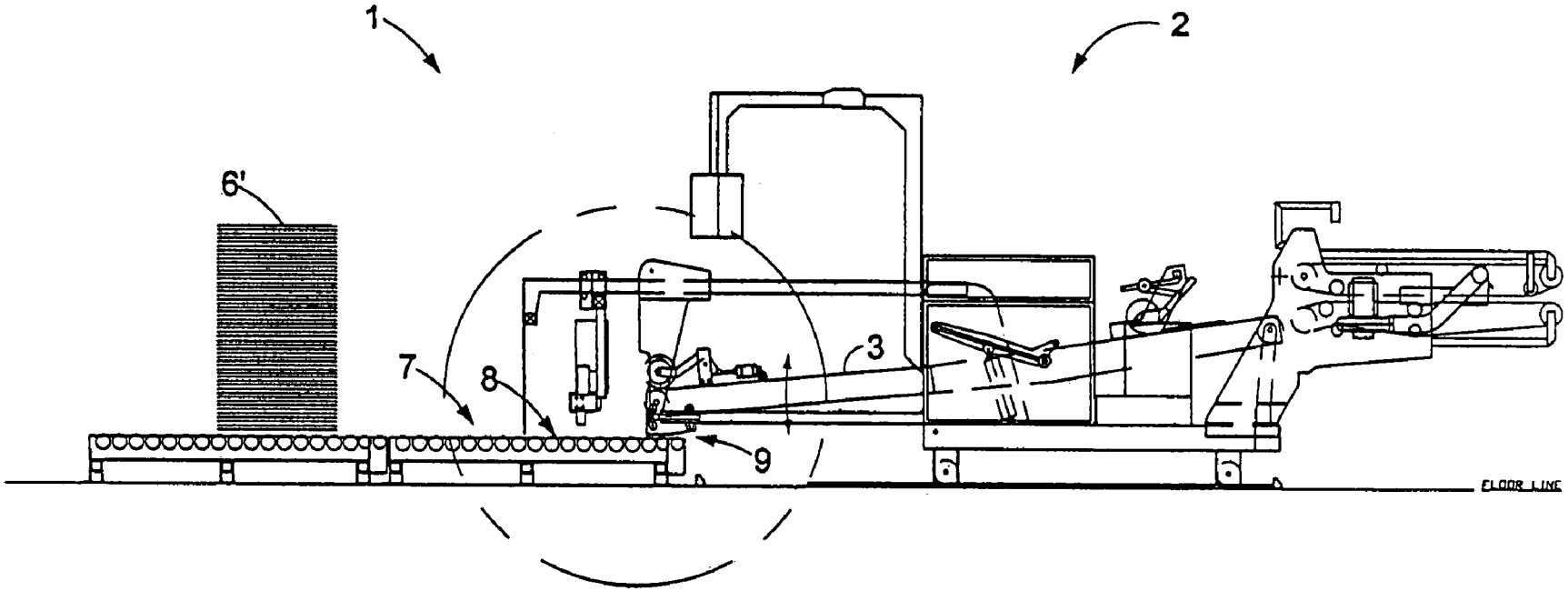
FIG. 7 is a variable pinch point gap 9 for an upstacking sheet stacker 2 of the present invention with minimal pinch point gap.
Figure 8:
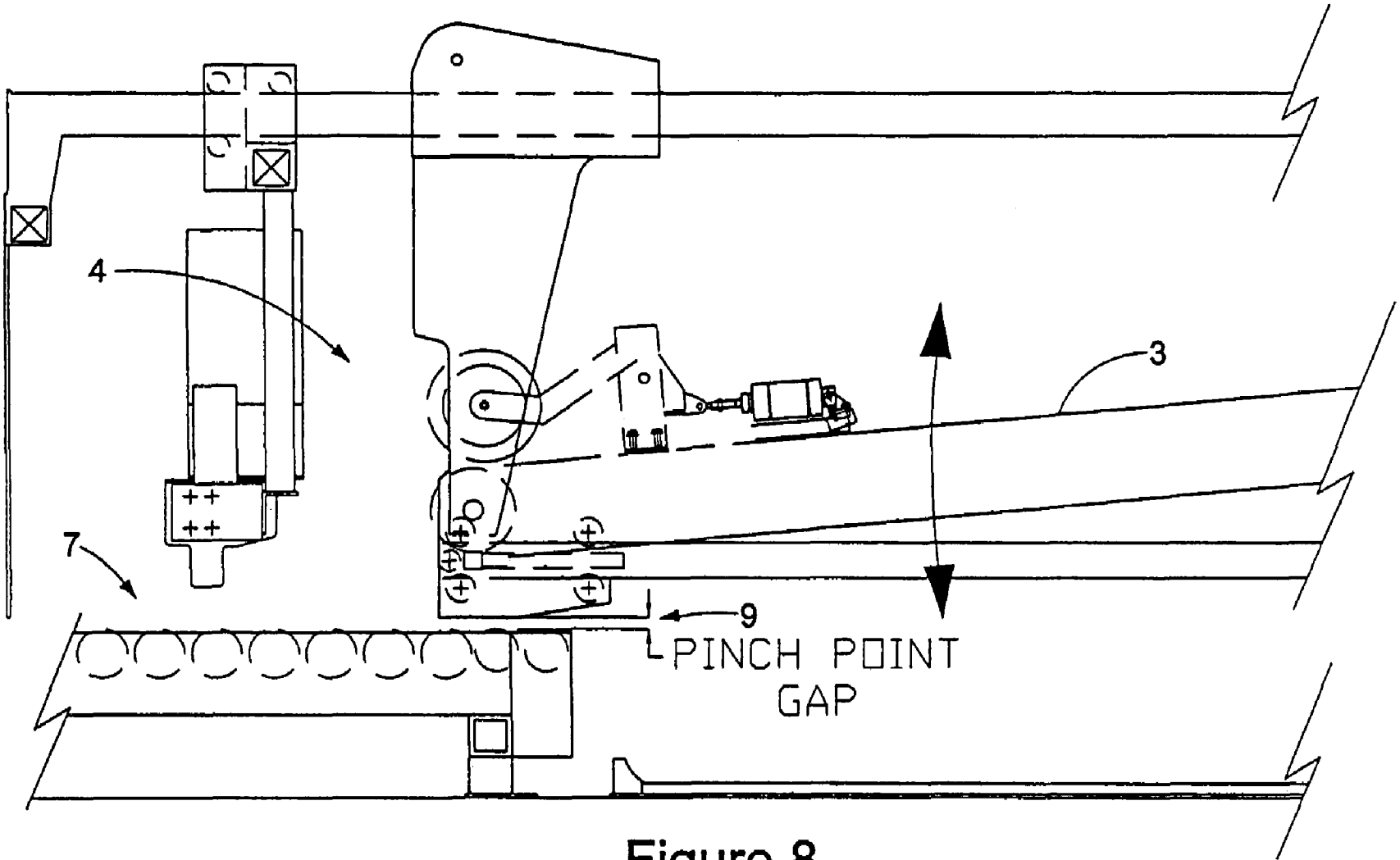
FIG. 8 is a zoomed in view of FIG. 7.
Figure 9:
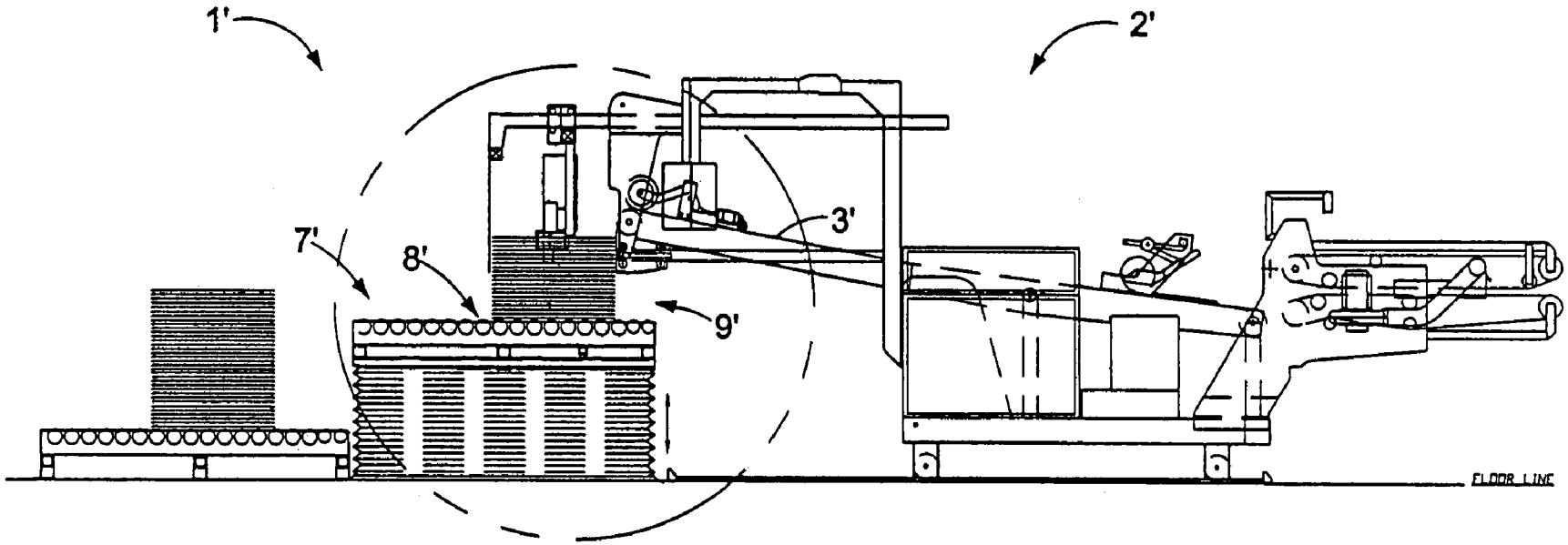
FIG. 9 is a variable pinch point gap 9' for an downstacking sheet stacker 2' of another form of the present invention with a substantial pinch point gap.
Figure 14:
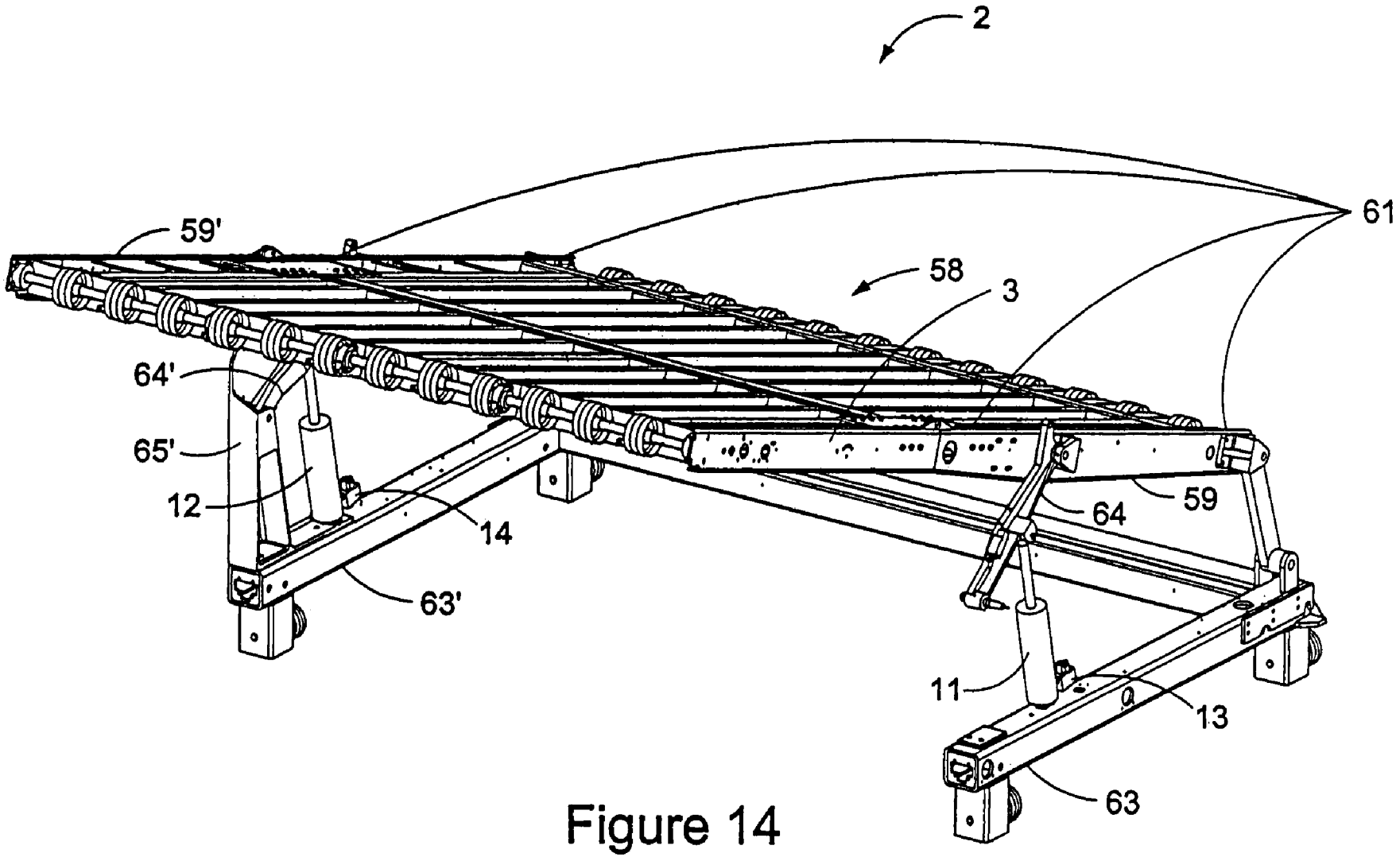
FIG. 14 is a perspective view of a sheet stacker 2 of the present invention showing the substantially rigid stacking deck 3 supported by a pair of hydraulic cylinders 11,12.
Figure 15:
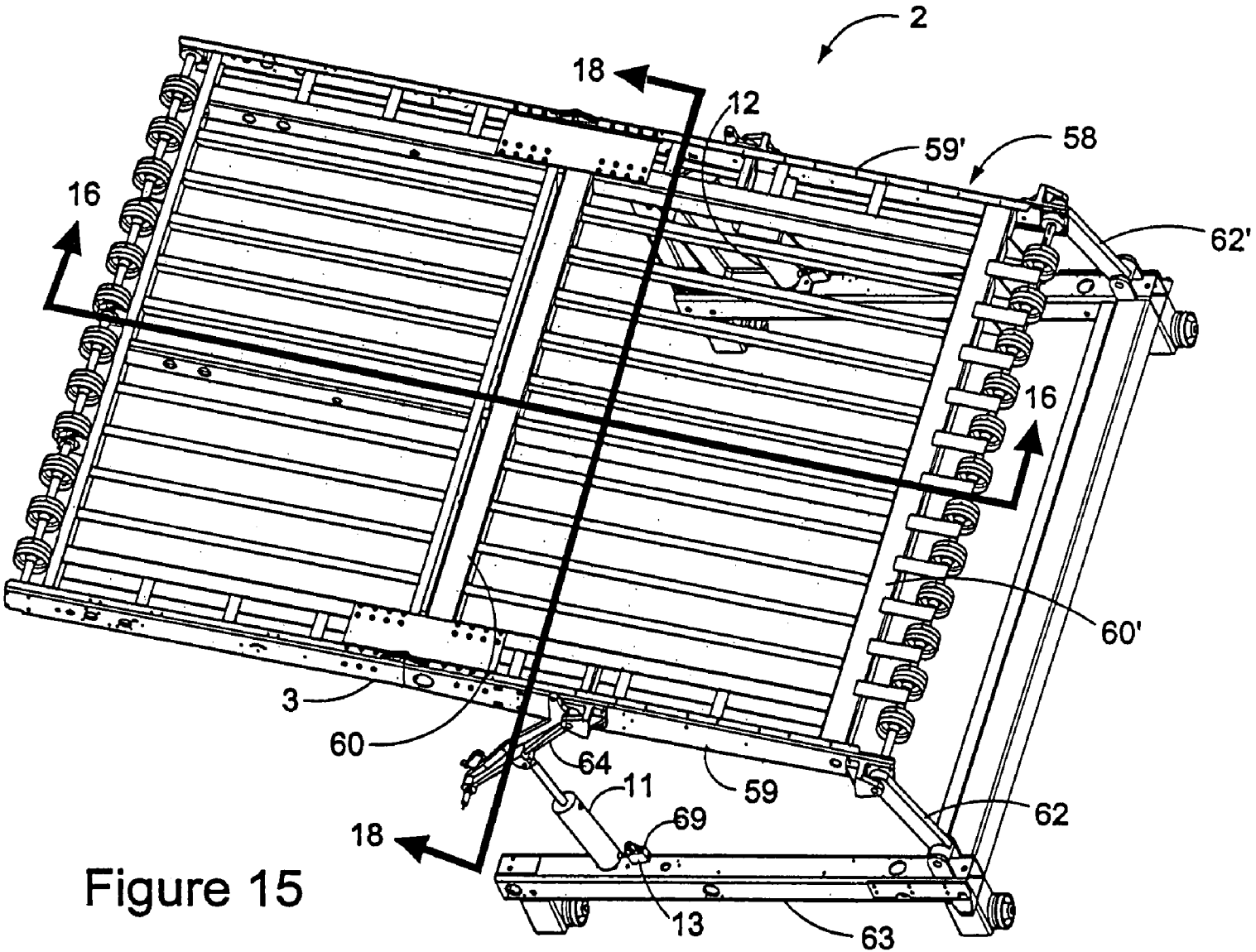
FIG. 15 is an alternative perspective view of the sheet stacker 2 of FIG. 14 showing the substantially rigid stacking deck 3 emphasizing the stacking deck 3 construction.

An upstacking sheet stacker 2 has a variable pinch point gap 9 which decreases as shown by two positions, first in FIG. 6 and then in FIG. 8. This is due to gravities affect on the moveable stacking deck 3. FIGS. 14 & 15 show two different perspective views of a typical upstacker stacking deck 3. In this preferred embodiment, you will note the rear deck 58 is constructed using side wall members 59, 59' and cross torque tubes 60, 60' such that the box frame created forms a planer surface 61. Since the cross torque tubes 60, 60' are able to resist torque, typically made from rectangular tubing, the rear deck 58 is a substantially rigid structure that attempts to keep planer surface 61 flat when rigidly pinned for pivoting by swing arms 62, 62'. The four bar linkage created by the rear deck 58, swing arms 62,62', the stacker base 63 and lifting arms 64, 64' creates a nearly straight vertical motion at the discharge end 4 of the stacking deck 3 when the lifting arms 64,64' are operably connected to support hydraulic cylinders 11,12. In FIGS. 14 & 15 the side casting 65 opposite 65' has been removed for clarity but may be seen in FIG. 18. The hydraulic cylinders 11, 12 provide redundant support, due to the existence of the substantially rigid structure created by the rear deck 58 and the fact that either hydraulic cylinder 11 or 12 is capable of supporting the weight of the entire stacking deck 3. Should either cylinder fail to provide support, the deck will 'rack' slightly as the planer surface 61 warps slightly, but the deck does not come down substantially.

Figure 16:
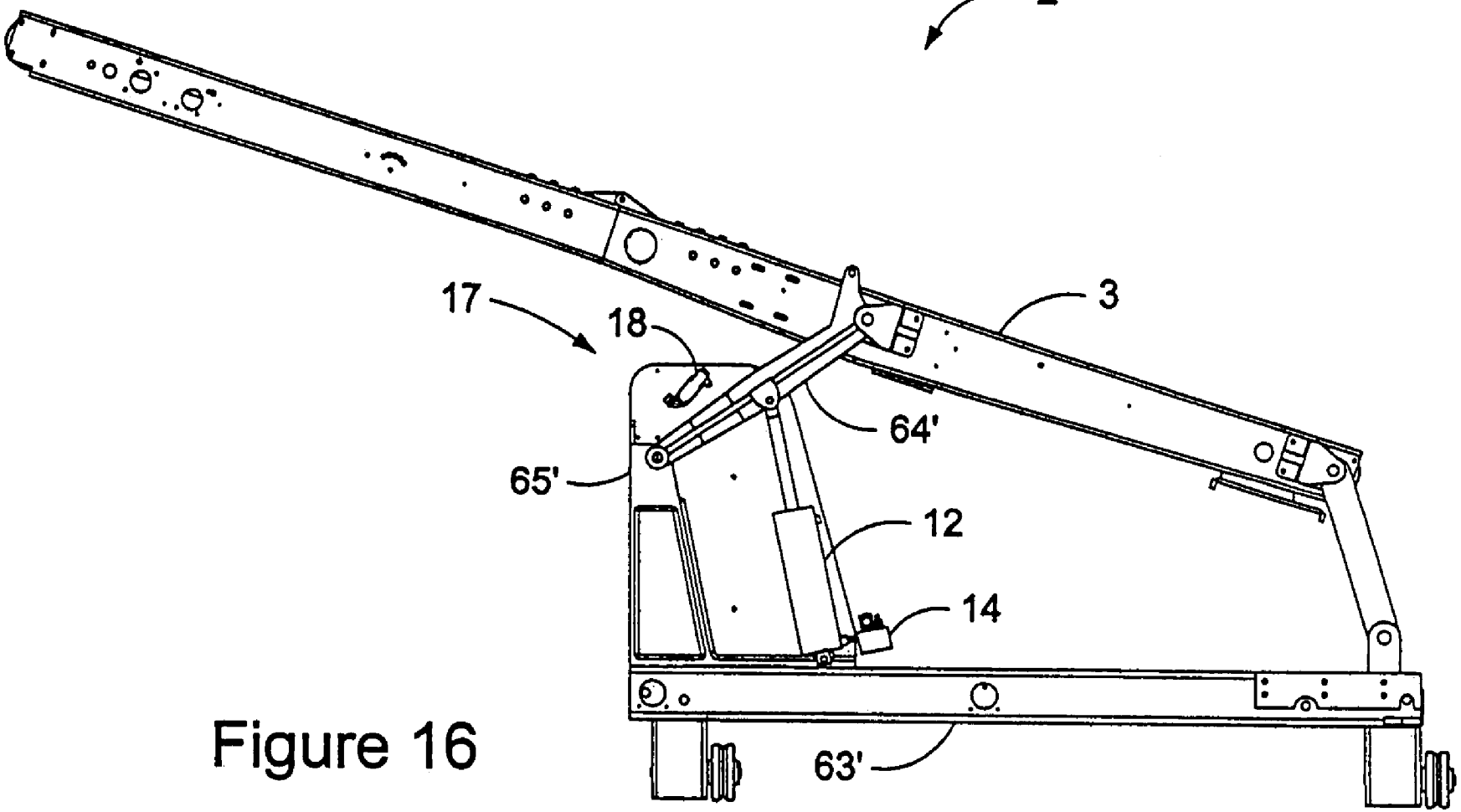
FIG. 16 is an inside side view if a portion of the sheet stacker 2 taken in the general direction of line 16—16 with portions of the sheet stacker removed to more clearly show the stacking deck 3 and portions of the redundant means 10, specifically one of two hydraulic cylinders 12 hydraulic lock valves 14 and self testing limit switch assemblies including hydraulic position sensors 18 are shown.

In FIGS. 16 & 17 are detail side views of the sheet stacker 2 when viewed from line 16—16 of FIG. 15. It shows the left side casting 65', left stacker lifting arm 64' and left hydraulic cylinder 12 connecting stacker base frame 63' to left stacker lifting arm 64'. If oil flows into left hydraulic cylinder port 66, the left hydraulic cylinders 12 rod extends 94 increasing the variable pinch point gap 9. Likewise, due to gravity, oil is naturally pressurized at all time to flow out of left hydraulic cylinder port 66. Connected to left hydraulic cylinder port 66 is first a left hydraulic velocity fuse 68. The left hydraulic velocity fuse 68 has a feature of locking up and stopping oil from exiting left hydraulic cylinder port 66 should the flow rate exceed a certain designed threshold; typically to keep a hydraulic line blowout from causing damage. While not required for the present invention, including a hydraulic velocity fuse 67, 68 on each cylinder is considered good practice. Then, connected to the left hydraulic velocity fuse 68 is hydraulic lock valve 14 which will let oil into hydraulic cylinders 12 via check valve but will only let oil out of hydraulic cylinder port 66 only if hydraulic lock valve solenoid 70 is energized. There is a separate and independent right hydraulics lock valve 13 connected in a redundant fashion to right hydraulic cylinders 11. The result is two independent and redundant support means or systems 10, with both right hydraulic lock valve solenoid 69 and left hydraulic lock valve solenoid 70 needing to be activated in order to allow a narrowing of variable pinch point gap 9.

The LCS system control means 15 shown in FIG. 20 allows the operator 30 to press a deck down enabled button 71 in order to electrically activate redundant hydraulic lock valve solenoids 69, 70. Said deck down enabled button 71 has redundant right and left deck down enabled contacts 72, 73 that will conduct electrical power down redundant paths to self testing means 74,75 which then may conduct to fault detection means 76, 77. The order of these paths are not important. In the simplest form, the redundant LCS system control means 15 would not have self-testing means 74,75 nor fault detection means 76,77. However, in the preferred embodiment, these elements are added to even further reduce the likelihood of an unsafe condition.

In the simplest form, the operator 30 would press the deck down enabled button 71 which is positioned such that the operator 30 is a safe distance from the variable pinch point gap 9. If the operator releases the deck down enabled button 71 both redundant paths would provide support to the stacking deck. However, should a single component fail on either redundant path, the variable pinch point gap 9 would still stop decreasing.

Figure 10:
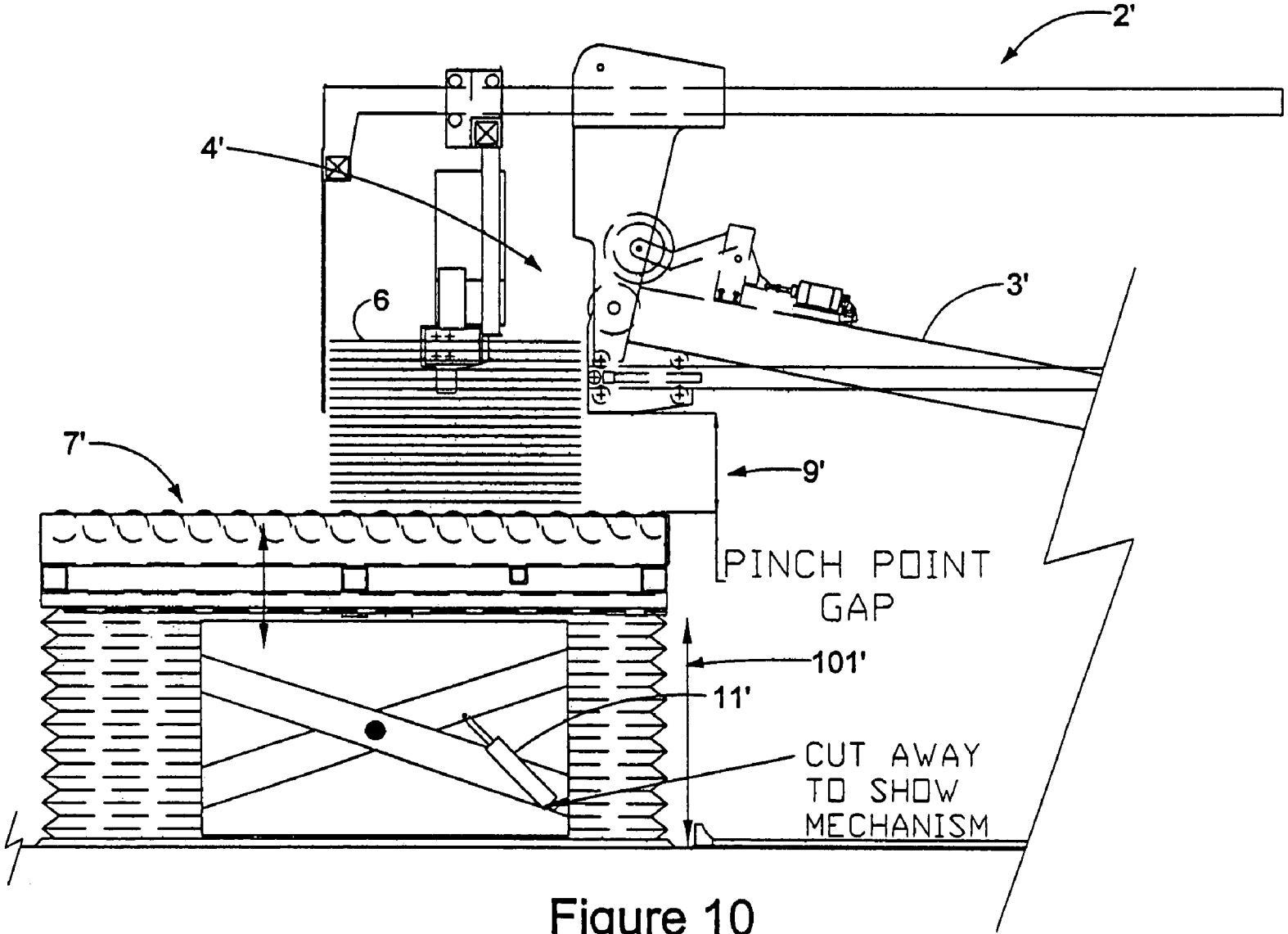
FIG. 10 is a zoomed in view of FIG. 9.
Figure 11:
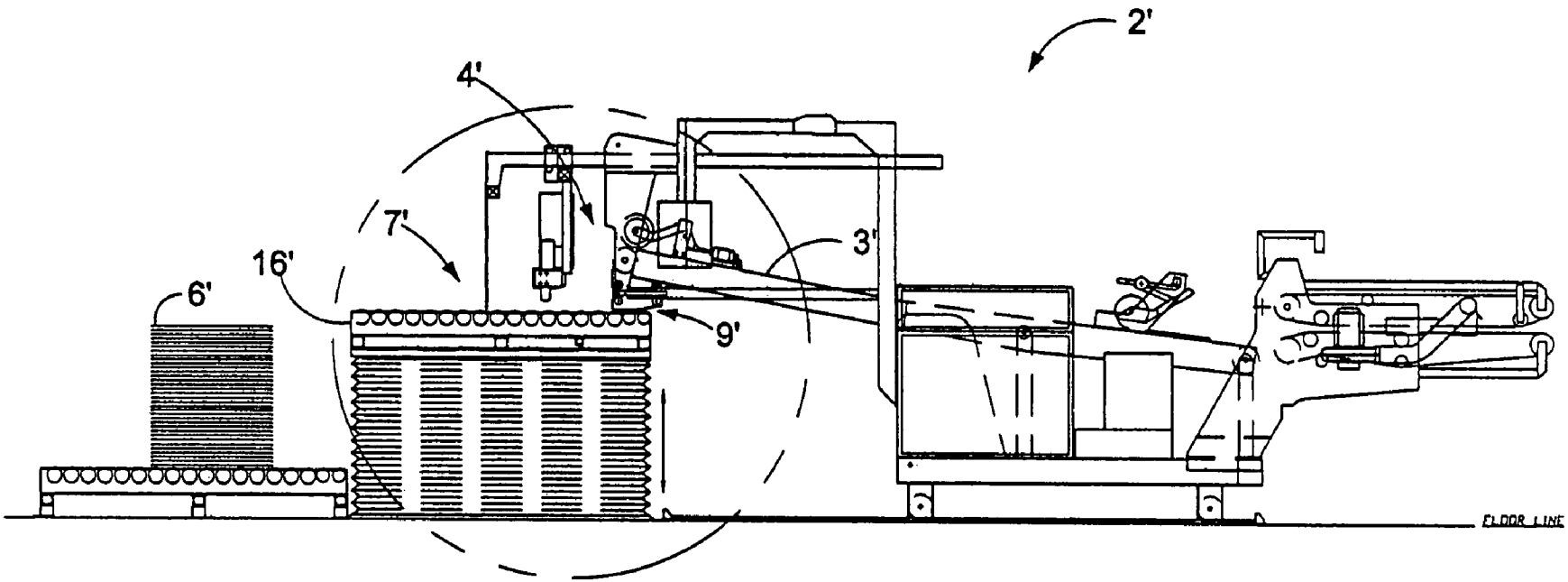
FIG. 11 is a variable pinch point gap 9' for a downstacking sheet stacker 2' of the present invention with minimal pinch point gap.
Figure 12:
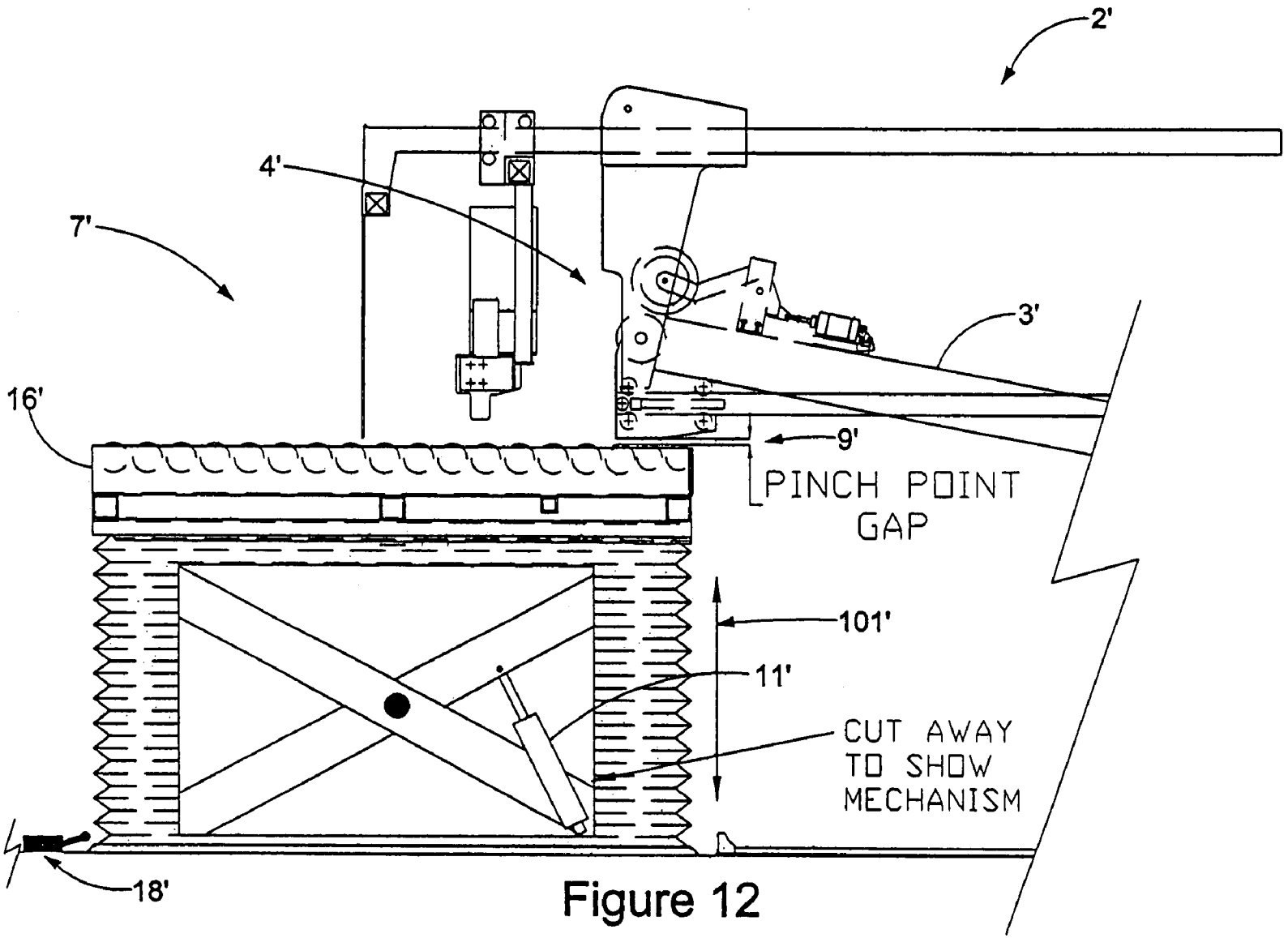
FIG. 12 is a zoomed in view of FIG. 11.

A downstacking sheet stacker 2' has a variable pinch point gap 9' which decreases as shown by two positions; first in FIG. 10 and then in FIG. 12. This is due to the raising of the conveying sheet material removal system 7'. Unlike an upstacker, see FIG. 6, in which gravity naturally tries to decrease the variable pinch point gap 9, with a downstacking sheet stacker 2', gravity is naturally trying to increase the variable pinch point gap 9', see FIG. 10. As a result, redundancy can be achieved by using only one hydraulic cylinder 11' or more than one hydraulic cylinders 11', 12'. A mechanical failure of the hydraulic cylinder 11' can not cause the variable pinch point gap 9' to decrease. In typical embodiments, there are a plurality of cylinders due to mechanical engineering requirements.

This invention could be applied to the variable point gap (101') that may exist between the bottom side of the conveying sheet material removal system (7') and the floor. However, in the interest of brevity, this will not be described in detail The redundancy means 10' involves using a plurality of hydraulic lock valves 13', 14' in a redundant LCS system control means 15' shown in FIG. 21. By placing the hydraulic lock valves 13', 14' in series, they both must be actuated and functioning normally in order to allow pressurized oil to flow into one or more than one hydraulic cylinders 11', 12', which in turn decreases the variable pinch point gap 9'.

Figure 21:
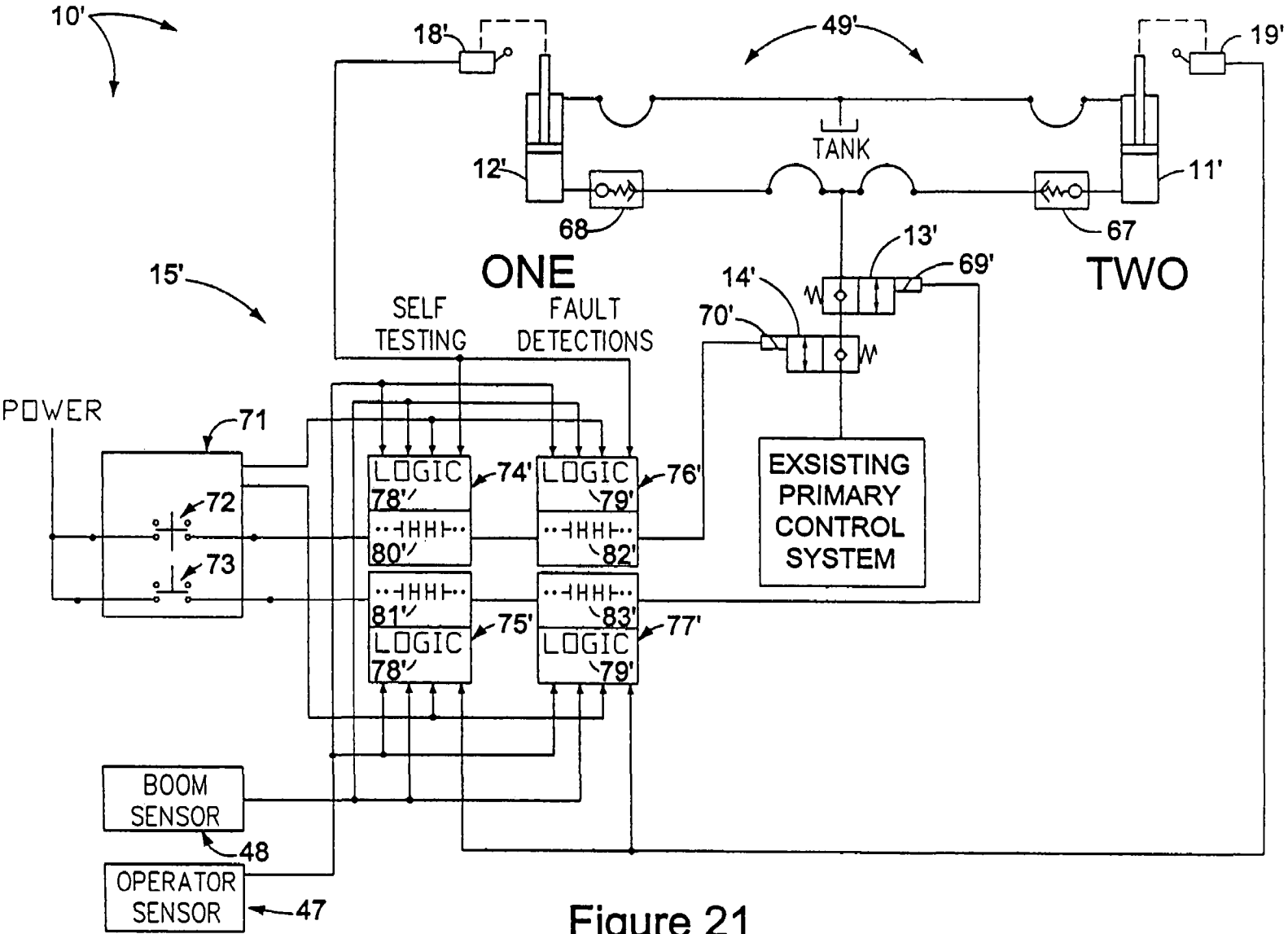
FIG. 21 is basic LCS system control means 15' hydraulic and electrical schematic for an downstacking sheet stacker 2'

The LCS system control means 15' shown in FIG. 21 allows the operator 30 to press a deck down enabled button 71 in order to electrically activate redundant hydraulic lock valve solenoids 69', 70'. Said deck down enabled button 71 has redundant right and left deck down enabled contacts 72, 73 that will conduct electrical power down redundant right and left paths to self testing means 74',75' which then may conduct to redundant right and left fault detection means 76',77'. The order of these paths are not important. In the simplest form, the redundant LCS system control means 15' would not have self testing means 74',75' nor fault detection means 76',77'. However, in the preferred embodiment, these elements are added to even further reduce the likelihood of an unsafe condition.

In the simplest form, the operator 30 would press the deck down enabled button 71 which is positioned such that the operator 30 is a safe distance from the variable pinch point gap 9'. If the operator releases the deck down enabled button 71 both redundant paths would provide support to the stacking deck. However, should a single component fail on either redundant path, the variable pinch point gap 9' would still stop decreasing.

Both LCS system control means 15, 15' use feedback from various sensor means 17, 17' in order to detect if a condition exists that requires making sure no power flows to redundant hydraulic lock valve solenoids 69, 70, 69', 70'. Some of these conditions are classified as self-testing in nature while others are considered to be faults.

Sensor means 17, 17' include hydraulic position sensor 18, 18', which is activated in one state at a predefined raised position of an associated hydraulic cylinder 11, 12. Should a failure of support occur in one of the hydraulic cylinders, the associated hydraulic position sensor 18, 18' will activate to a different state.

Sensor means 17 may also include the deck down enabled button 71, which can be monitored to determine if redundant contacts are synchronized and how long they have been in either state.

Sensor means 17 may also include the operator in position sensor 47, which can be monitored to determine if its output changes and how long it has been in either state. The operator in position sensor 47 is mounted on remote control means 35 operably connected to said sheet stacker 2 or 2'. The LCS system control means 15,15' monitors said operator in position sensor 47 to make sure the operator is a safe distance from the variable pinch point gap 9,9' while decreasing.

Sensor means 17 may also include the boom in position sensor 48, which can be monitored to determine if its output changes. Since the remote control means 35 is swivelly attached to or adjacent to said sheet stacker 2, 2', in the preferred embodiment, the boom in position sensor 48 makes sure the boom is in the position shown in FIG. 35 as opposed to the location shown in FIG. 36. This assures that the operator 30 has a good sightline to the area near the variable pinch point gap 9,9'.

Logic means for self testing 78,78' include but are not limited to: 1) periodic testing the load change hydraulic system 49,49' integrity, 2) proper functioning deck down enabled button 71, 3) proper functioning of boom in position sensor 48 and 4) proper functioning of operator in position sensor 47. If the self-testing conditions are not met, the self-testing contact chain 80,81,80',81' will not allow power to flow to hydraulic lock valve solenoid(s) 69,70,69',70'.

Logic means for fault detection 79, 79' include but are not limited to: 1) redundant hydraulic lock valve solenoids not being synchronized in the on or off state, 2) the deck down enabled button 71 being active for too long of a period and 3) the operator in position sensor 47 being active for too long of a period. If a fault condition is detected, the fault contact chain 82,83,82',83' will not allow power to flow to hydraulic lock valve solenoid(s) 69,70,69',70'.

The basic form of redundant means 10,10' for keeping the operator a safe distance from the variable pinch point gap 9,9' requires that the operator 30 holds down the deck down enabled button 71 anytime the variable pinch point gap 9,9' is decreasing. However, there are production line configurations where this is not practical or economical. For instance, in a bundling application where the sheet stacks 6 are built short to form bundles, not shown, the cycle time of the discharge end 4 the stacking deck 3 can be so short that the operator 30 would end up spending nearly all his/her time holding the deck down enabled button 71.

Figure 22:
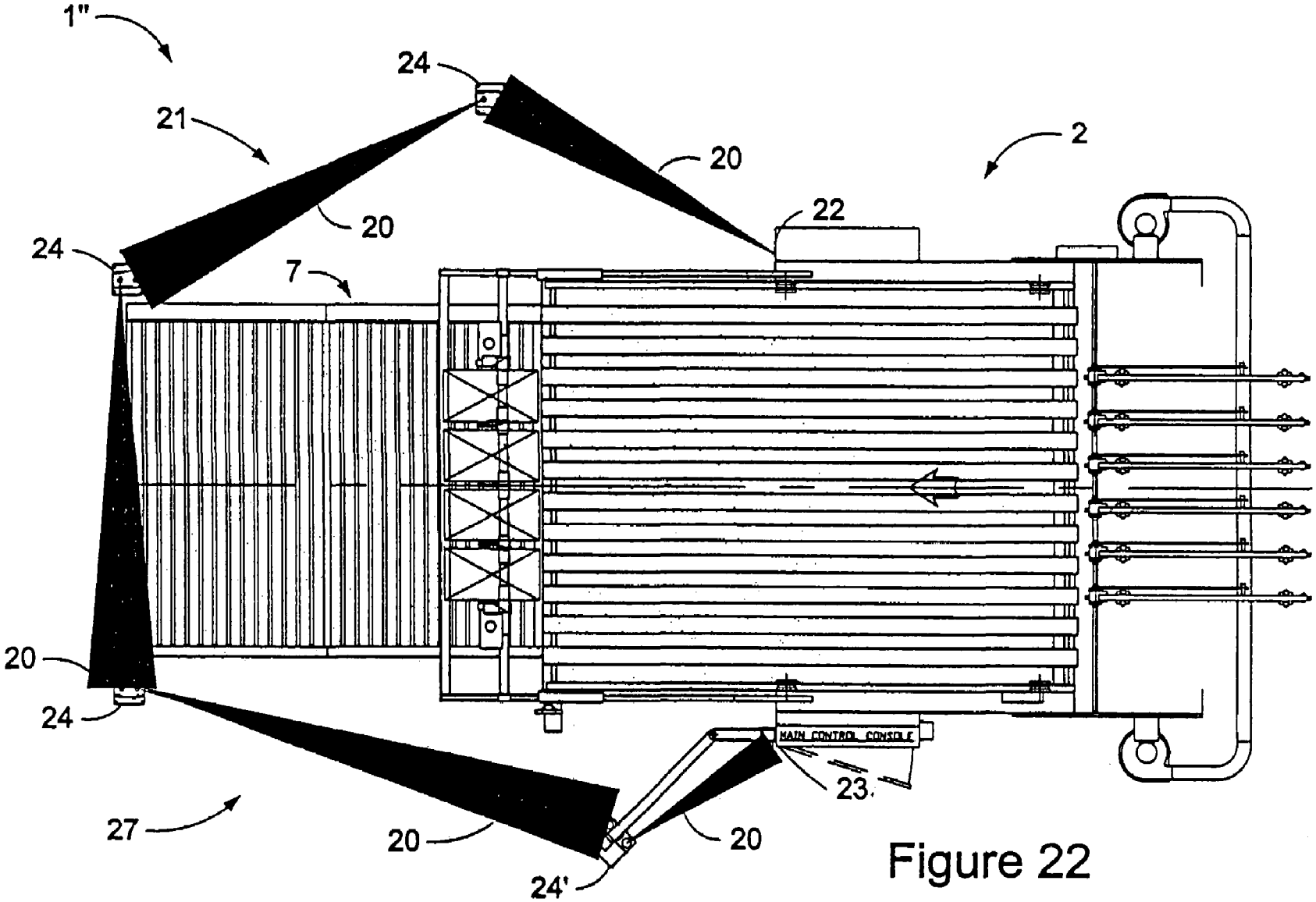
FIG. 22 is a schematic of a typical optical circuit required to create a light guard around a sheet stacker 2,2' using light beam transmitter 22, light beam receiver 23 and a plurality of optical repeating nodes 24,24' of the present invention to redirect the light.

In order to solve this problem, the present invention includes an electro-optical light guard means 27, see FIG. 22, that is activated by the operator 30 from outside the light guard perimeter 21 after the operator 30 first visually checks to make sure the area within the light guard perimeter 21 is clear of other personnel and then presses a light guard activation button in order to latch the light guard control circuit 85 to an active state. The term latch indicates that the light guard control circuit 85 will remain active until another event, such as the light guard perimeter 21 being crossed or loss of power to sheet stacker 2,2' should occur. Thus, after activating the light guard control circuit 85, the operator 30 may walk away from light guard activation button, leaving the redundant means 10,10' in a state allowing a decrease in variable pinch point gap 9,9'. The light guard activation button is operably connected to the deck down enabled button 71 in the preferred embodiment. This light guard control circuit 85 is operably connected to the light guarded LCS system control means 15",15'" which operably controls the redundant means 10, 10' for selectively preventing a decrease in variable pinch point gap 9,9'.

Figure 24:
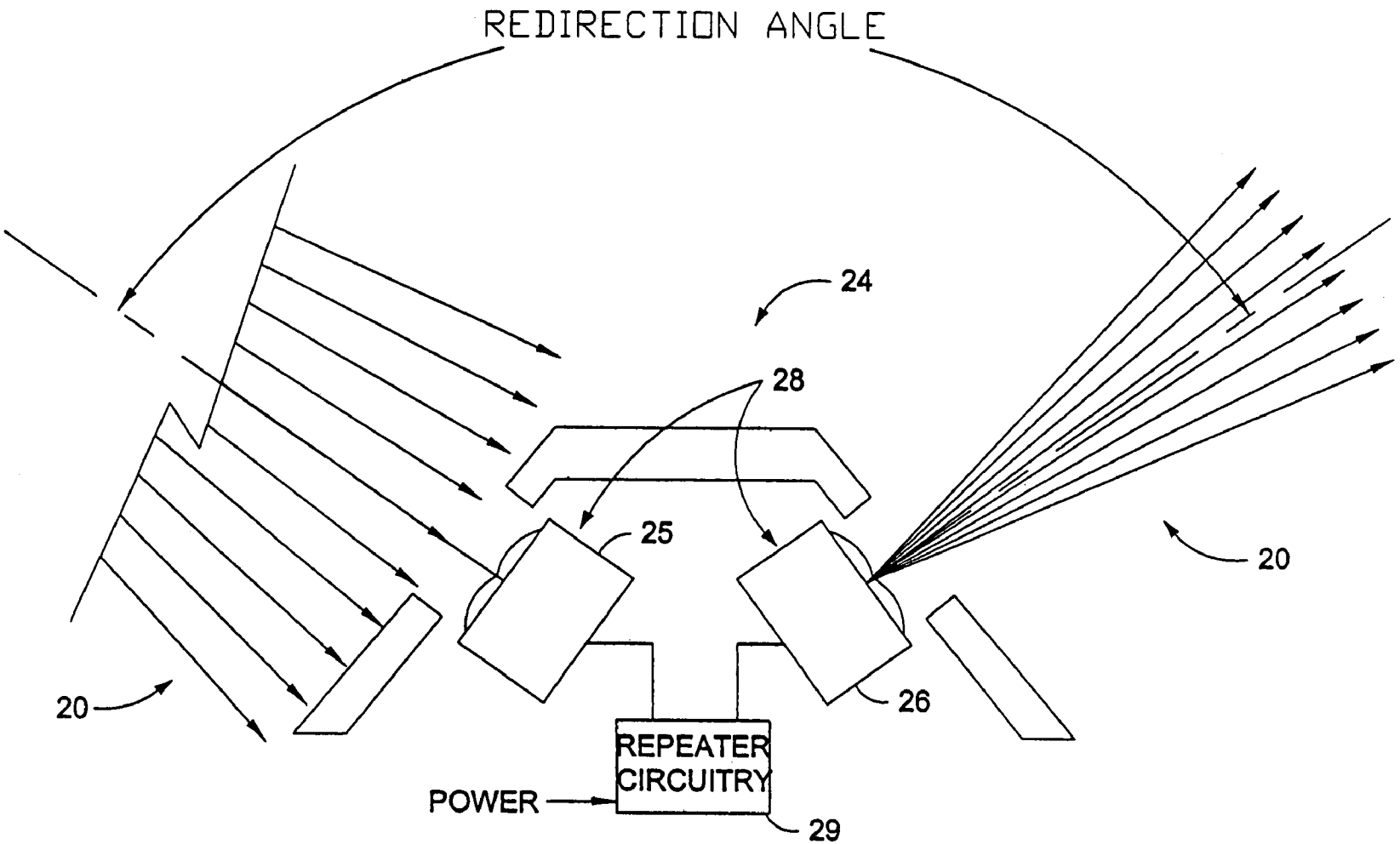
FIG. 24 is a detail view of an optical repeating node 24,24'.

The light guard perimeter 21 is constructed by using one or more light beam (s) 20,20' that must be redirected multiple times in order to create the appropriate perimeter around portions of the sheet stacker 2, 2' and portions of the conveying sheet material removal system 7,7' such that when an operator 30 or other person should break the light guard perimeter 21, the redundant means 10,10' can prohibit a decrease in variable pinch point gap 9,9'. Each light beam circuit starts with a light beam transmitter 22 that converts an electrical signal into an optical signal. The redirection is accomplished using an optical repeating node 24,24', as illustrated in FIG. 24. Unlike conventional mirrors used to redirect the light beam, the optical repeating node (s) 24,24' uses a repeater pair 28 which consist of an repeater optical receiver 25 which is aligned in the general direction of the incoming light beam 20. The repeater optical transmitter 26 is electronically connected by repeater circuitry 29 to its associated repeater optical receiver 25 such that the optical signal received by the repeater pair transmitted at the new redirected angle by the repeater optical transmitter 26. The repeater circuitry 29 needs to meet the electrical engineering requirements of the selected electro-optical components, but in the preferred embodiment, the repeater circuitry 29 does not include any sophisticated clock base electronics, such as micro-controllers or other crystal based components. This is to assure that an optical data signal initiated by the light beam transmitter 22 can only be repeated and received by light beam receiver 23 by properly functioning repeater pair(s).

Figure 25:
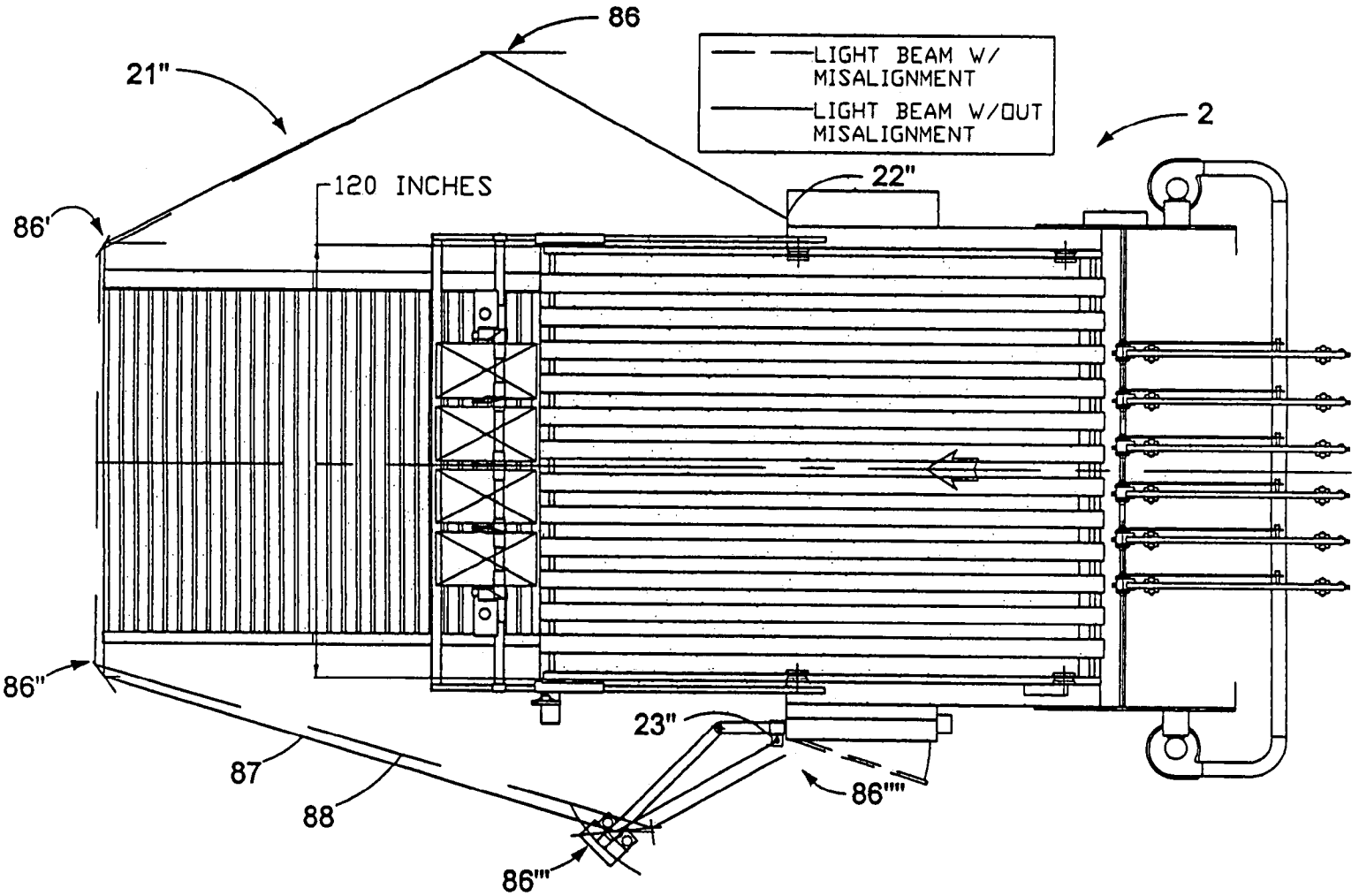
FIG. 25 is a schematic of a typical optical circuit that would be required to create a light guard around a sheet stacker 2,2' using one transmitter, one receiver and a plurality of mirrors to redirect the light.
Figure 26:
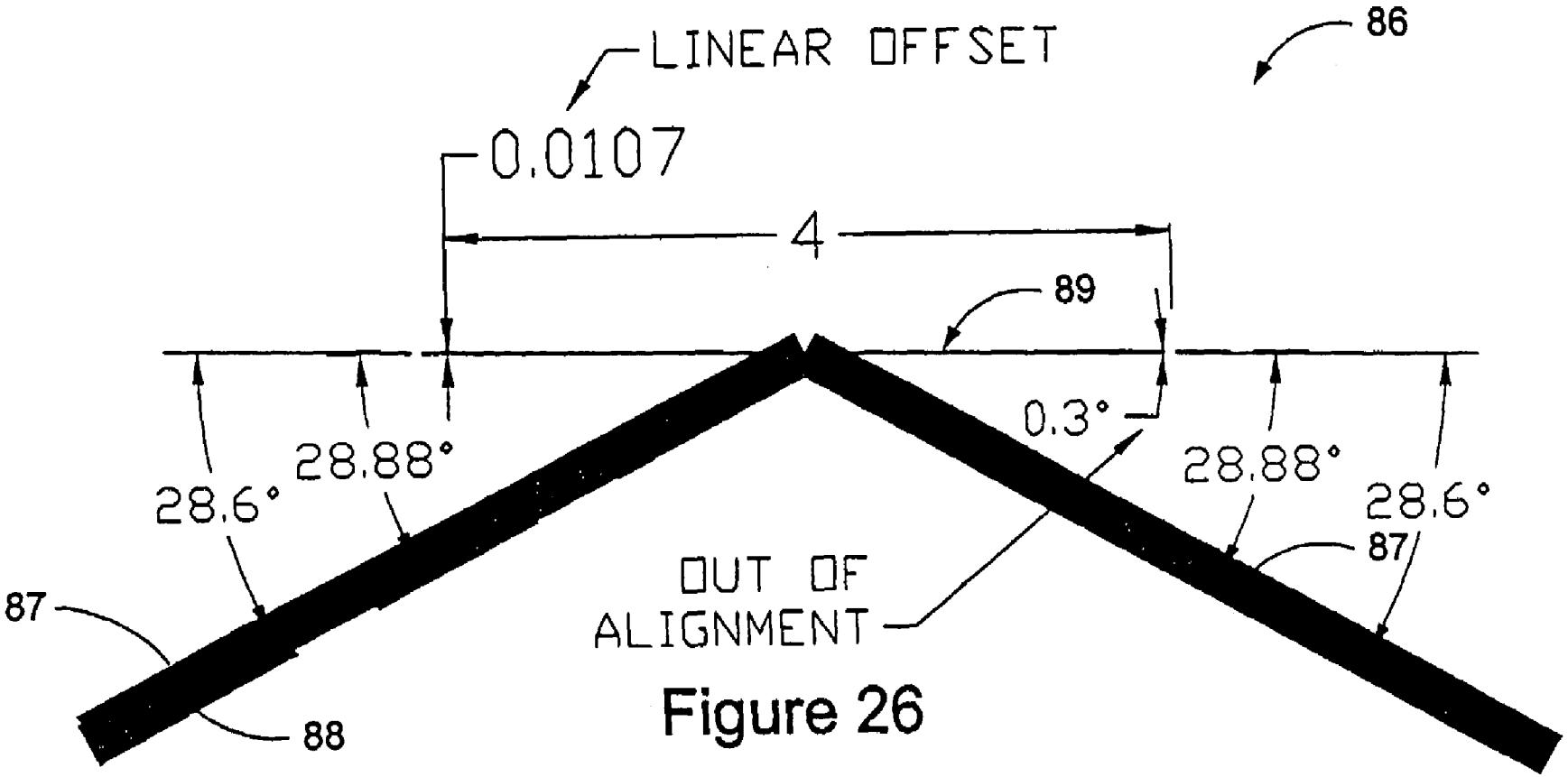
FIG. 26 is a detail view of a mirror 86 in FIG. 25
Figure 27:
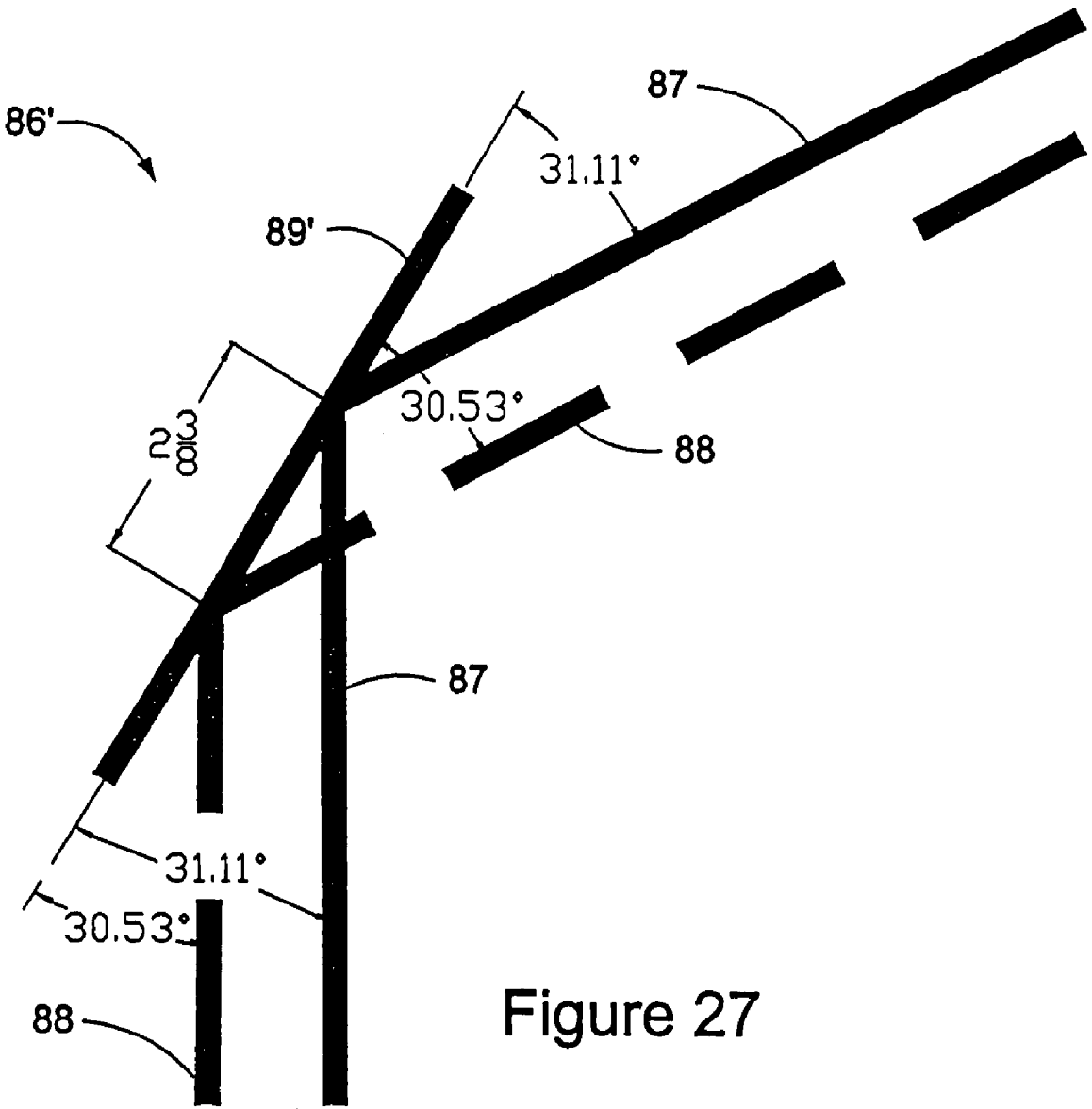
FIG. 27 is a detail view of a mirror 86' in FIG. 25
Figure 28:
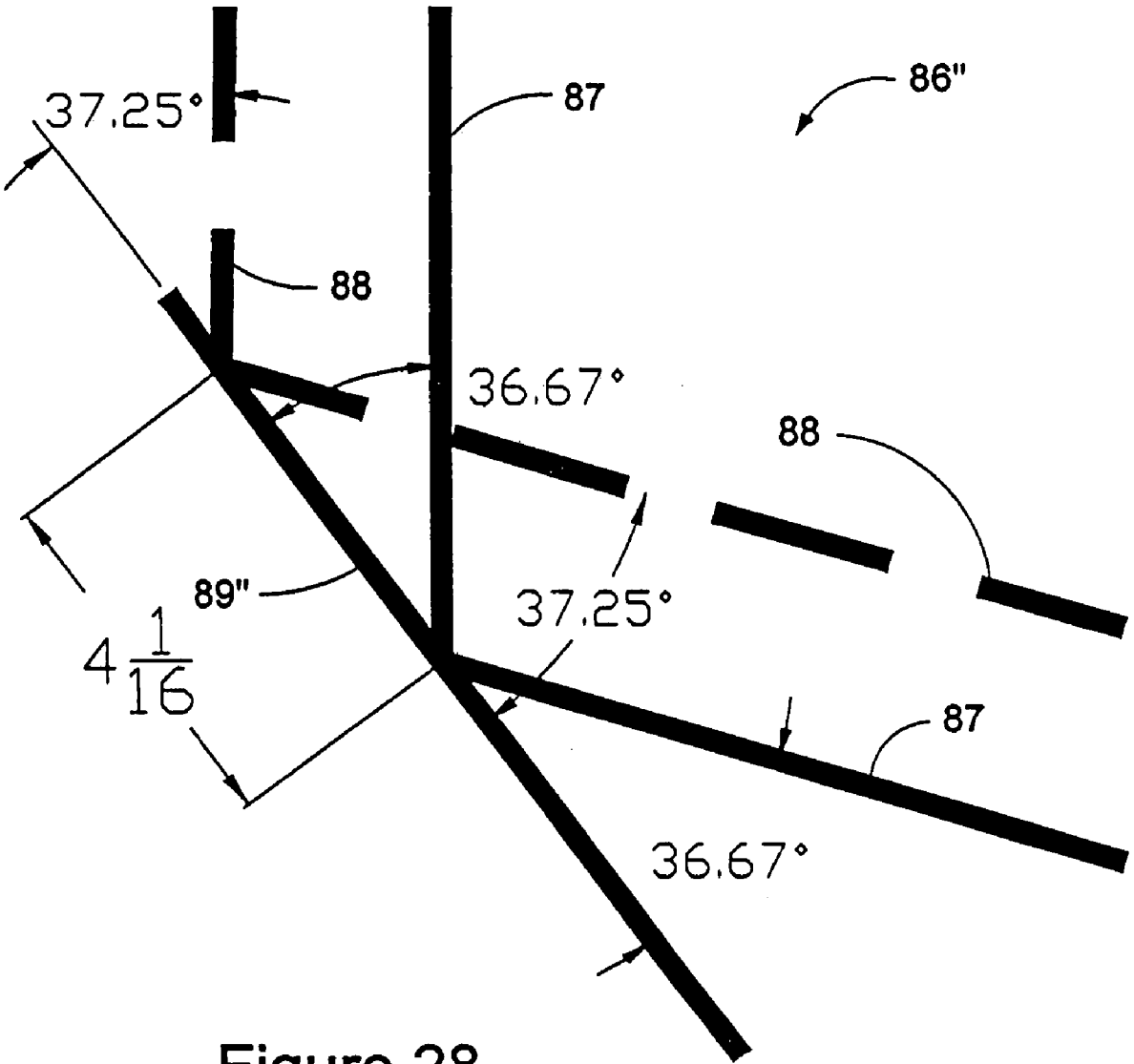
FIG. 28 is a detail view of a mirror 86" in FIG. 25
Figure 29:
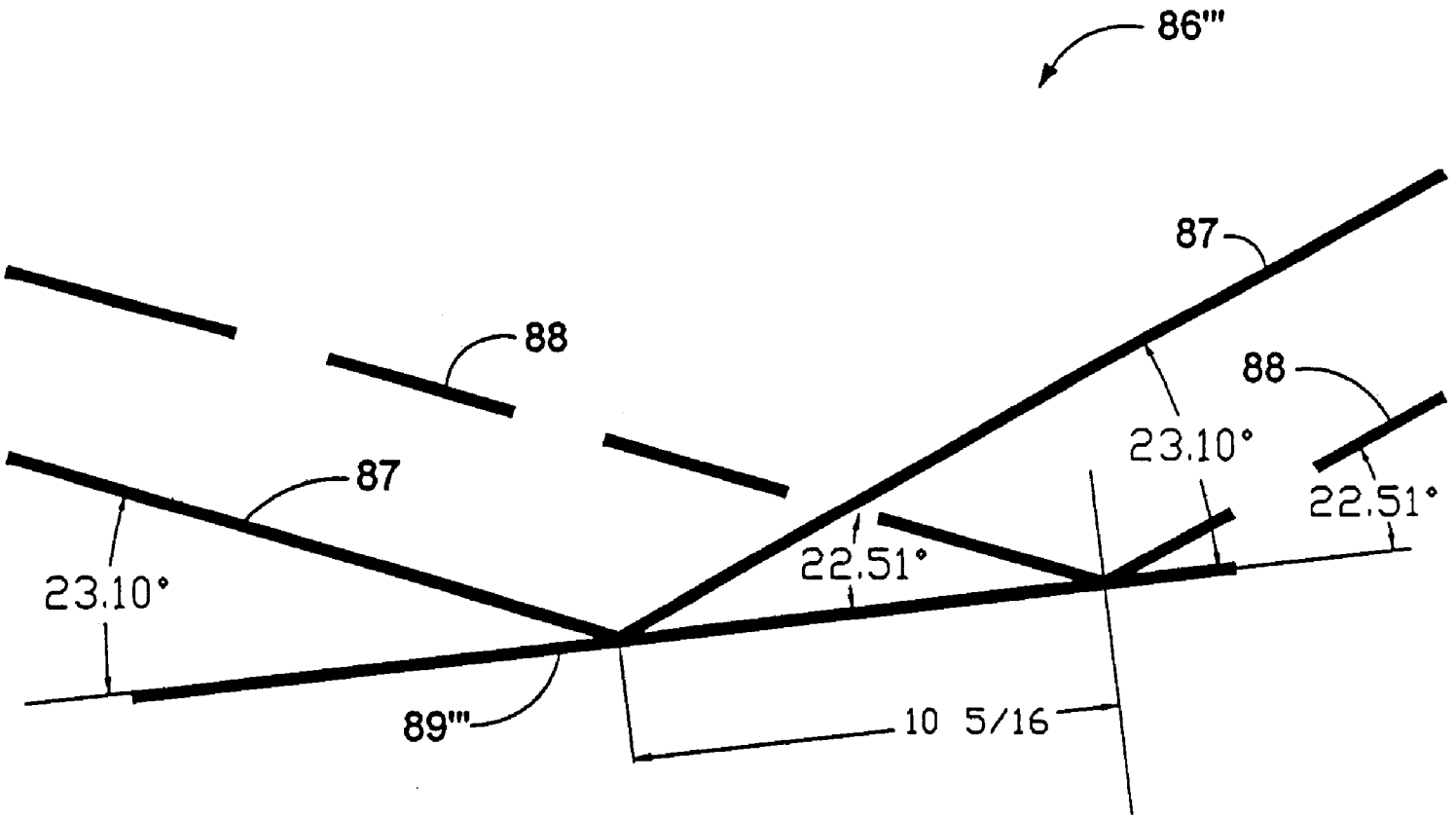
FIG. 29 is a detail view of a mirror 86'" in FIG. 25
Figure 30:
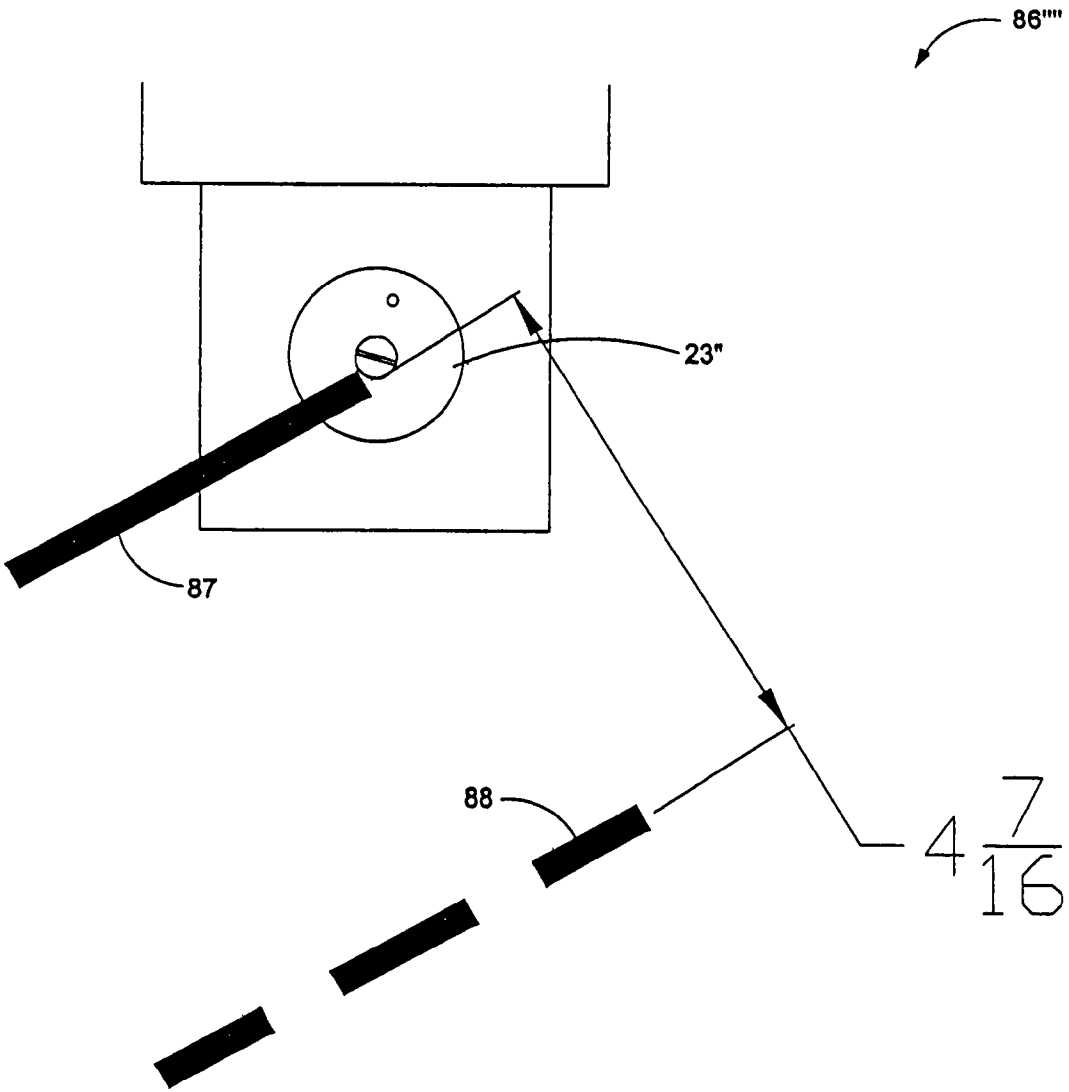
FIG. 30 is a detail view of a mirror 86"" in FIG. 25
Figure 31:
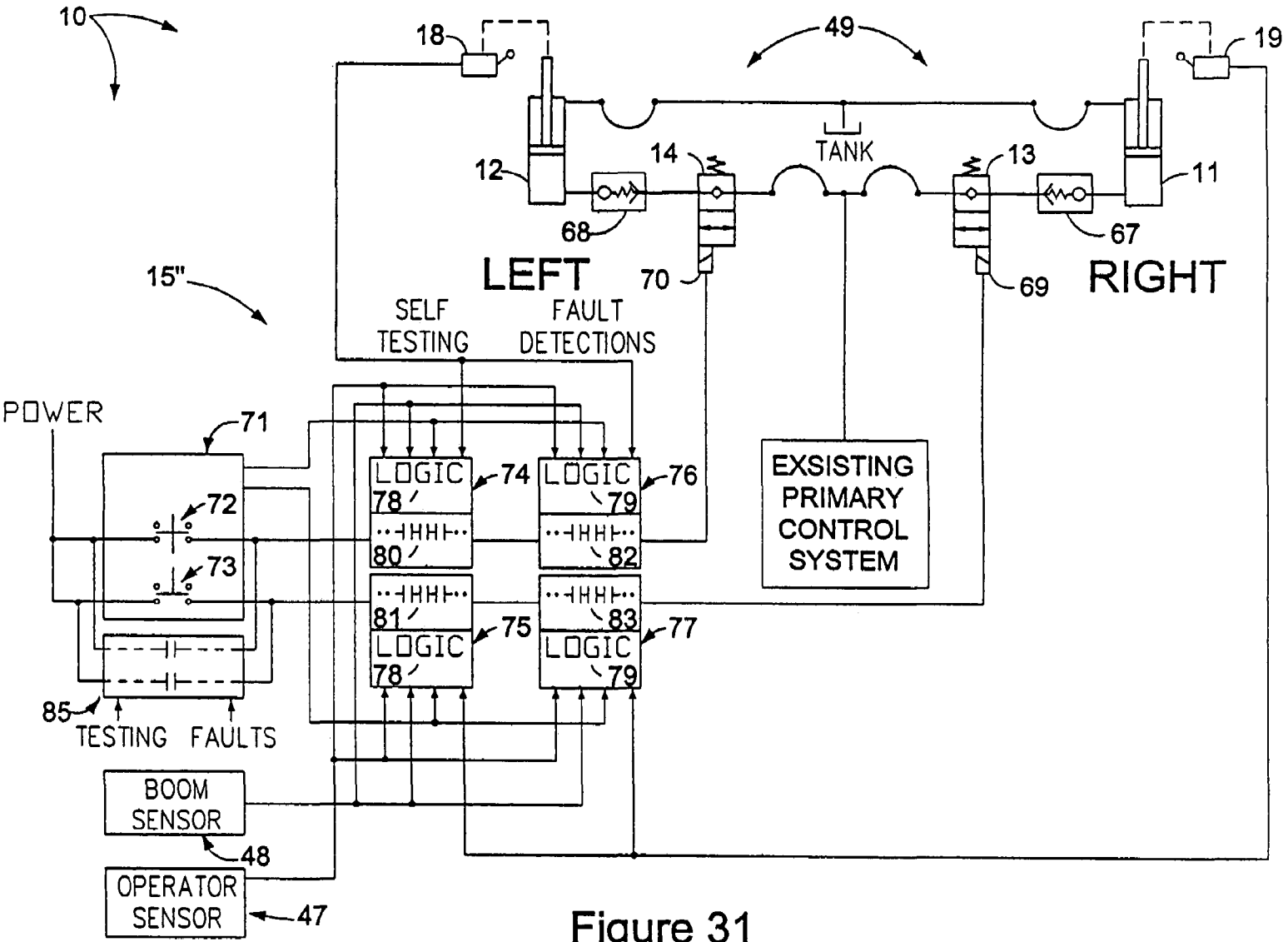
FIG. 31 is the light guarded LCS system control means 15" hydraulic and electrical schematic for an upstacking sheet stacker 2
Figure 32:
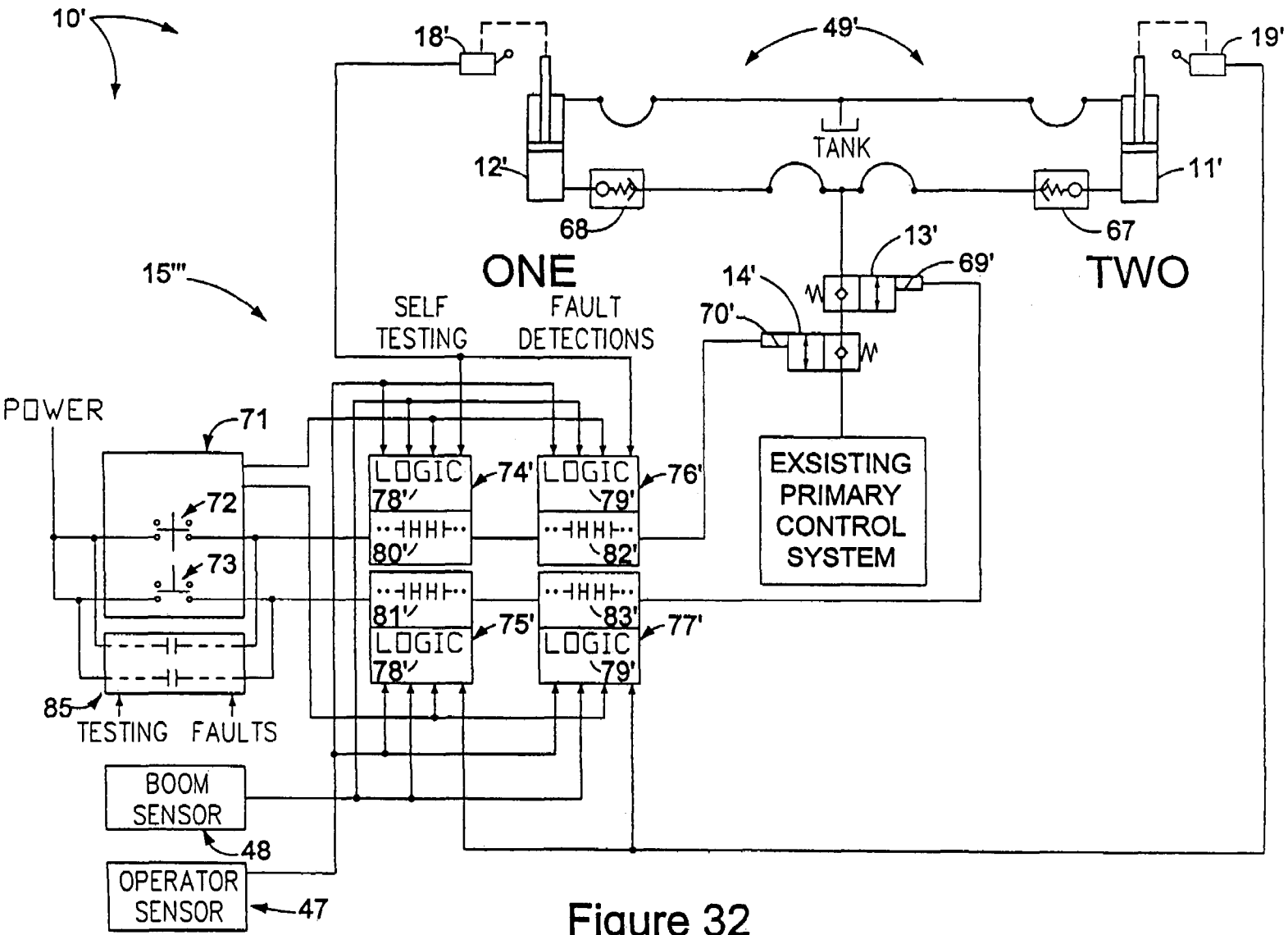
FIG. 32 is the light guarded LCS system control means 15'" hydraulic and electrical schematic for a downstacking sheet stacker 2
Figure 33:
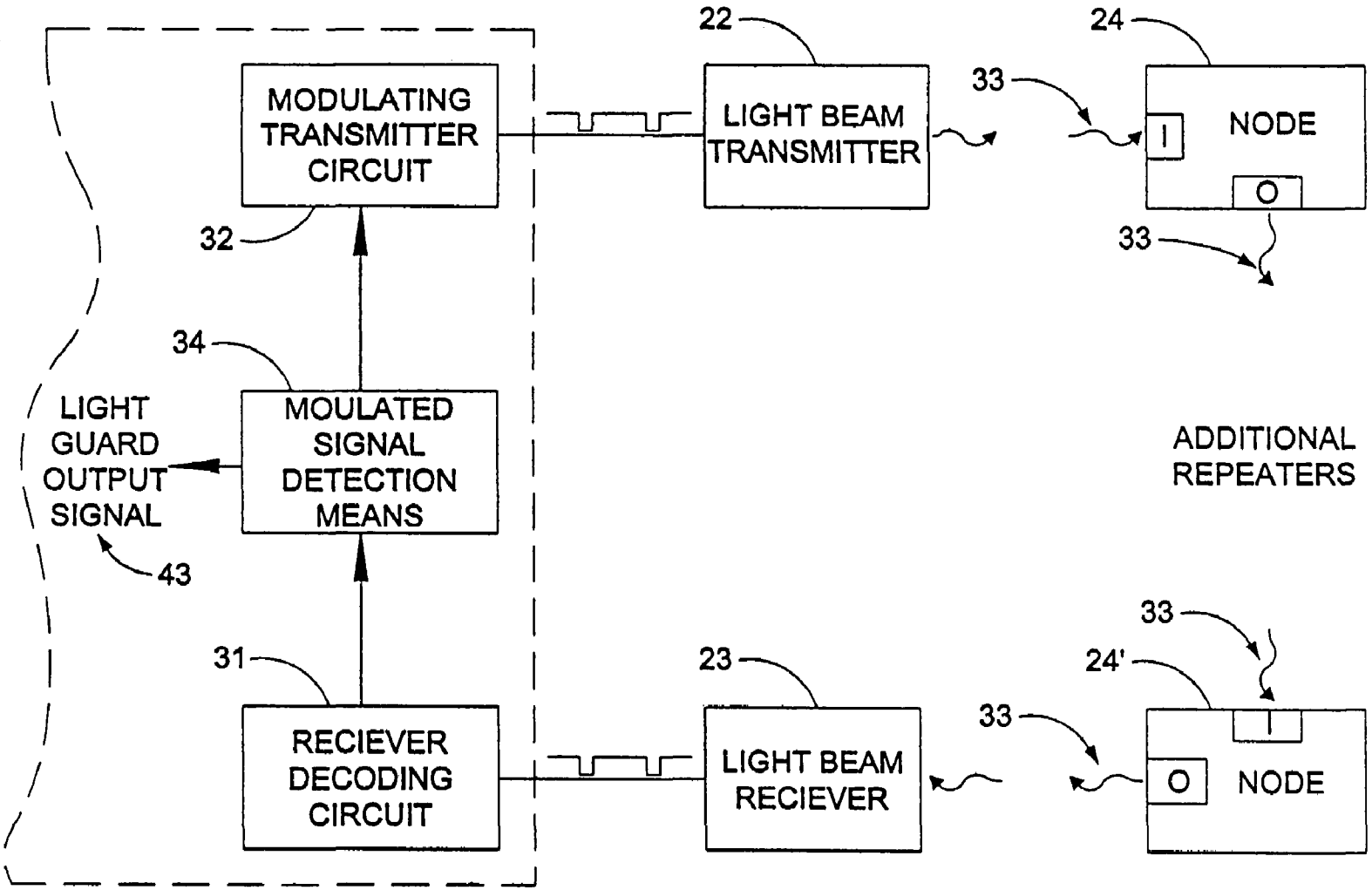
FIG. 33 is a schematic describing how the light guard system modulated self test and fault detection operates.

The advantage of using the optical repeating node(s) 24,24' instead of using reflective mirrors 89–89'" is illustrated in FIGS. 25–30. In FIG. 25, a scaled version of a sheet stacker 2 was drawn in planned view, using AutoCAD with a light guard perimeter 21" created using a light beam transmitter 22", a series of mirrors 89–89'" at stations 86, 86', 86", 86'" and a light beam receiver 23" at station 86'". A dimension of 120 inches has been added to Figure to give the drawing scale. By applying the basic physics of light where the angle of incidence equals the angle of reflection, a perfectly aligned light guard perimeter 21" was created using light guard beam 87. Then, in order to show how sensitive a reflective mirror system is to misalignment, the mirror at the first station 86, which is assumed to be 4 inches in size, see FIG. 26, is misaligned by approximately 0.010 inches. This correlates to an angular misdirection of approximately 0.3 degrees. Then, assuming all the other mirrors 89'–89'" remain in perfect alignment, which is quite an assumption in heavy industry, the light beam is redrawn as misaligned light guard beam 88, again using the basic law of reflection. As shown in FIG. 26, the angle of reflect is off by approximately 0.3 degrees. In FIG. 27, when the light rays arrive at station 86', the misaligned light guard beam 88 is off by 2⅜ inches. At station 86", in FIG. 28, the misaligned light guard beam 88 is off by 4 1/16 inches. At station 86'", in FIG. 29, you would now need over a 20 inch mirror, since the misaligned light guard beam 88 is over 10 inches off center line. By the time the misaligned light guard beam 88 gets to the light beam receiver 23" in FIG. 30, it is off by over 4 inches. In addition to this tremendous sensitivity to angular misalignment, a reflective mirror system also has the poor characteristic of accumulating misalignment error. That is, if the mirrors 89', 89" at station 86' and 86" both have a misalignment, the error would add to each other.

The optical repeating system of the present invention essentially uses a transmitter and receiver to create each straight section of the light guard perimeter 21. Since the preferred optical transmitters generates a cone of light, the preferred optical receiver has a lens to allow for rays of light to enter to a certain amount of angular misalignment, an angular misalignment of 3 degrees or more are easily achieved. In addition to the 10 times or more forgiveness to misalignment, the optical repeating system does not accumulate misalignment error. By referring to FIG. 24, it is clear that any misalignment of the rays of beam coming into repeater optical receiver 25 has no impact on the alignment of repeater optical transmitter 26. The only disadvantage of the optical repeating system compared to the reflective mirror system is the fact that the repeating nodes typically require an external power supply.

Figure 23:
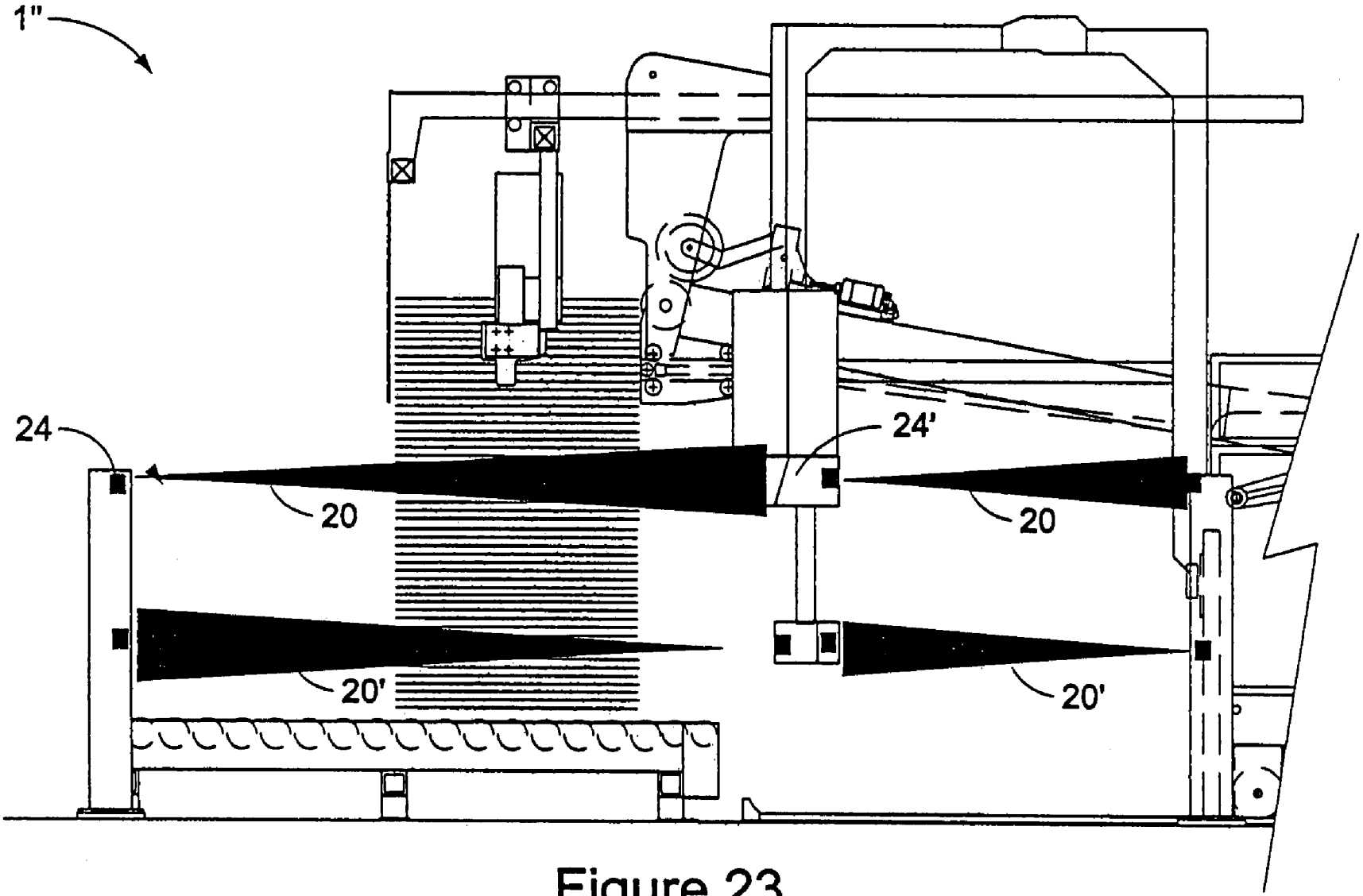
FIG. 23 is a side view of FIG. 22

In the preferred embodiment, the light guard means 27, includes two light beam 20,20' circuits, separated vertically as shown in FIG. 23. The number of light beams, their vertical locations and the distance of the light beams from the variable pinch point gap 9,9' are based on using safety standards as a guideline and computer simulated biomechanical analysis of trip scenarios. When using two beams, it is preferred to have the top beam 20 and the bottom beam 20'±s12v1P directed in opposite direction, to further eliminate the possibility of cross talk between the two beams.

A load change safety system 1" of the present invention for a sheet upstacker 2 having a stacking deck 3, formed with a discharge end 4, for discharging sheet material 5 onto and building a sheet stack(s) 6 on a conveying sheet material removal system 7, formed with a receiving means 8 may consist of the following elements.

In such systems, a variable pinch point gap 9 is formed by relative motion between the discharge end 4 of the stacking deck 3 of the sheet stacker 2 and the receiving means 8 of the conveying sheet material removal system 7. In the present invention, redundant means 10 is provided for selectively preventing a decrease in the variable pinch point gap 9.

To guard personnel from this pinch point gap 9, an electro-optical light guard means 27 is operably connected to the redundant means 10 with one or more redirections of one or more light beams 20 to create a light guard perimeter 21 for guarding portions of the sheet stacker 2 and portions of the conveying sheet material removal system 7.

The electro-optical light guard means 27 includes one or more light beam transmitters 22 and one or more light beam receivers 23. The electro-optical light guard means 27 further includes one or more optical repeating nodes 24 or 24' using an optical receiver 25 and an optical transmitter 26 for creating the redirection of the light beam(s) 20.

The redundant means 10 also includes a plurality of hydraulic cylinders 11 and 12 for raising and lowering the stacking deck 3. The hydraulic cylinders 11 and 12 must be of adequate strength such that should one cylinder 11 or 12 fail to provide a support for the stacking deck 3, the remaining cylinder 11 or 12 can support the weight of the stacking deck 3.

A plurality of valves 13 and 14 are provided wherein at least one valve 13 or 14 is independently connected to each of the cylinders 11 and 12 which may selectively and alternatively permit and prevent flow of fluid from those of the hydraulic cylinders 11 and 12 which are operating normally and have not failed, thereby resulting in rapidly preventing the variable pinch point gap 9 from narrowing.

A light guard control means 15" is operatively connected to the electro-optical light guard means 27 and operatively and independently connected to each of the valves 13 and 14 for alternatively permitting and preventing flow of fluid from the hydraulic cylinders 11 and 12. The load change safety system 1'" for a down stacker system is nearly identical to the load change safety system 1" for an upstacker system as described immediately above, but with the following changes.

The redundant means 10' include one or more hydraulic cylinders 11', 12' for raising and lowering an elevating platform 16' of the conveying sheet material removal system 7' instead of being mounted on the upstacker 2.

Further, while only a single cylinder is required for raising the platform 16', generally two or more cylinders are provided for other reasons. In such systems, a plurality of valves 13' and 14' are provided wherein the valves 13' and 14' are operatively connected to each other and the cylinders 11' and 12' by means such that all of the valves 13' and 14' must simultaneously be activated and operate normally for selectively and alternatively permitting and preventing flow into the hydraulic cylinders 11' and 12' which are operating normally and have not failed, thereby preventing the variable pinch point gap 9' from narrowing.

In the present invention the pinch point gap 9' is protected by a light guard control means 15'" operatively connected to the electro-optical light guard means 27 and operatively and independently connected to each of the valves 13' and 14' for alternatively permitting and preventing flow of fluid into the hydraulic cylinders 11',12'.

Since any electro-optical component can fail and the failure can result in a sensor output in the on or off state, the electro-optical light guard means 27 requires a modulated signal detection means 34 such that a failure of an electro-optical component in either state will send the same light guard output signal as if the light guard perimeter 21 is blocked. A modulated transmitter circuit is connected to the light beam transmitter(s) 22 such that the modulated signal detection means 34 can generate a defined modulated optical signal 33 in series around the light guard perimeter 21 via optical repeating nodes 24,24'. A receiver decoding circuit 31 feeds back to the modulated signal detection means 34 the electrical equivalent of the defined modulated optical signal 33. The modulated signal detection means 34 can determine if the modulated signal has been properly received. Since the signal must be modulated, a failure of any electro-optical component in either the on or off state can be interpreted as a blocked light guard perimeter 21 and the associated signal sent as the light guard output signal 43. Of course, an actual blockage of the light guard perimeter will generate the proper signal sent as the light guard output signal 43.

The light guard output signal 43 is operably connected to light guarded LCS system control means 15", 15'". When the light guard output signal 43 indicates a blockage of the light guard perimeter 21, the associated light guard control circuit 85 will be deactivated which operably controls the redundant means 10,10'; preventing a decrease in the variable pinch point gap 9,9'.

In addition to making sure that the a failure of any electro-optical component results in a fail-safe mode, the modulated signal detection means 34, in the preferred embodiment, is also connected to the fault detection mean 76,77 since certain failures can be detected.

In the preferred embodiment, there is an independent modulated signal detection means 34 for each light guard beam 20, 20'.

In prior art, FIGS. 1, 2, 3 & 4, the light guard perimeter was created using two way redirections of the light guard light beams and fixed post mounted to the ground as the starting and stop points for the light guard perimeter. In addition to not providing an adequate distance between the light guard perimeter and the pinch point of concern, this system results in the nuisance of having a floor mount post in the way of the operator 30.

Figure 34:
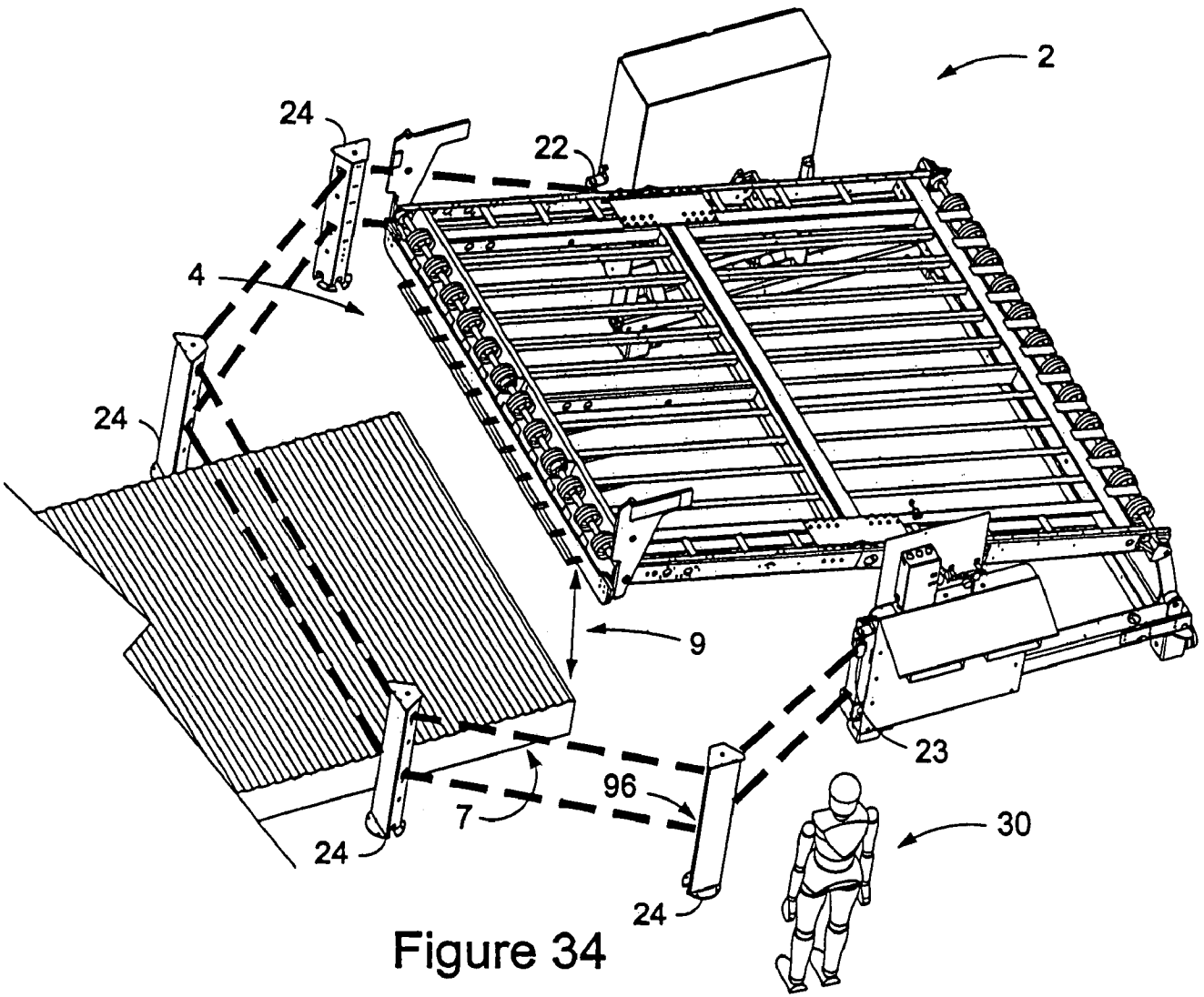
FIG. 34 is a perspective view of a sheet stacker 2 without a boom in which a light guard perimeter is created by using a floor mounted optical repeating node 24 in close proximity to where the operator 30 normally works.

This invention teaches the idea of using a four way redirection of the light guard light beams and starting and stopping points for the light guard perimeter mounted to the machine. This allows a greater distance between the light guard perimeter and the pinch point of concern. However, while using a floor mount optical repeater node as shown in FIG. 34 would provide the greater distance, it would still not solve the problem of the nuisance of having a floor mounted post 96 in the way of the operator.

Figure 35:
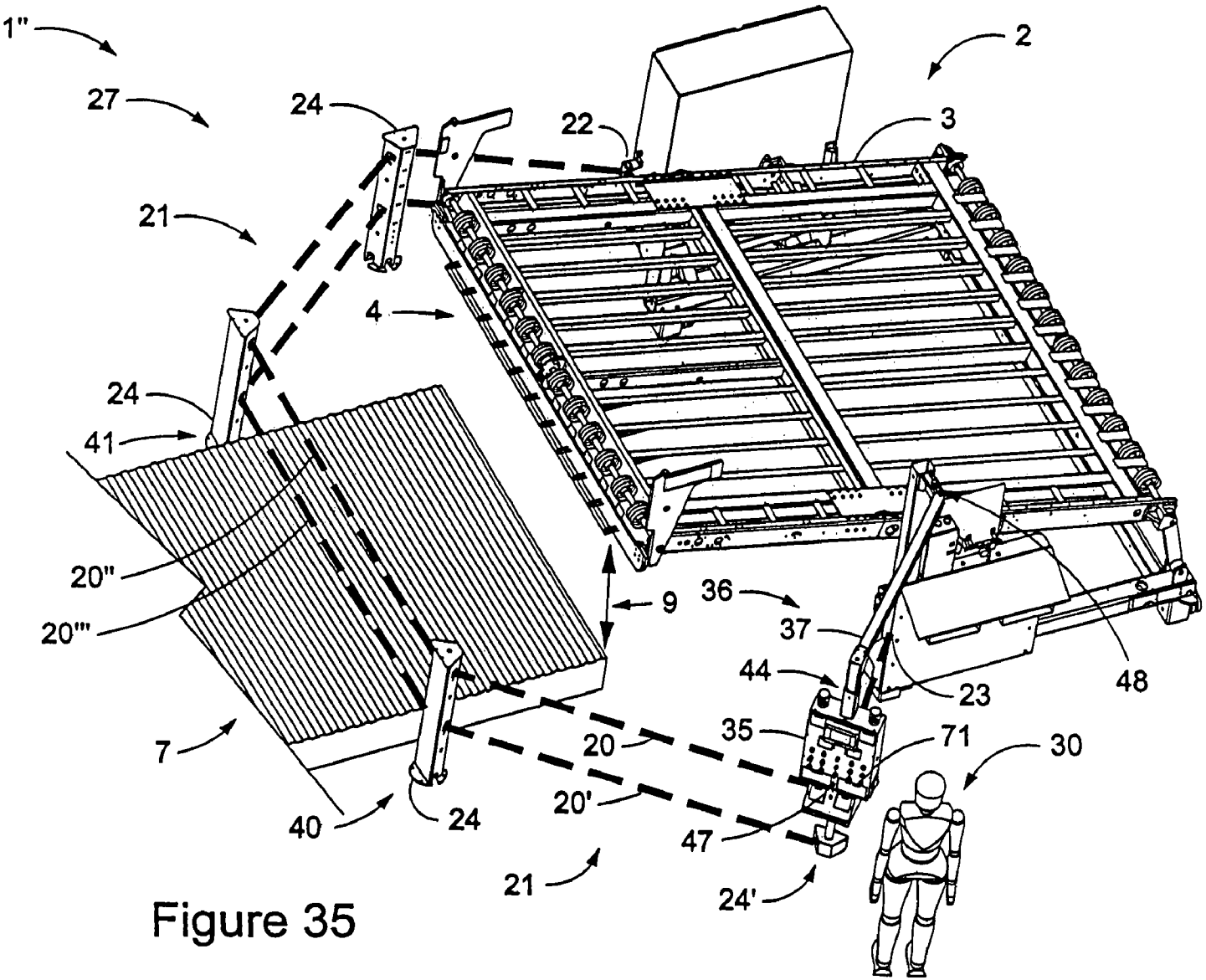
FIG. 35 is a perspective view of a sheet stacker 2 with a boom in which a light guard is created by mounting the optical repeating node 24' on the boom which is in close proximity to where the operator 30 normally works.

This invention includes a solution to this problem, as shown in FIG. 35. A remote control means 35 is connected to the sheet stacker 2 and positioned so that the operator 30 has a good visual vantage point for observing the variable pinch point gap 9,9' and the light guard perimeter 21. The remote control means 35 includes deck down enabled button 71 which in the preferred embodiment both allows basic enabling of the decreasing of variable pinch point gap 9,9' and also the activating the light guard control circuit 85.

Figure 36:
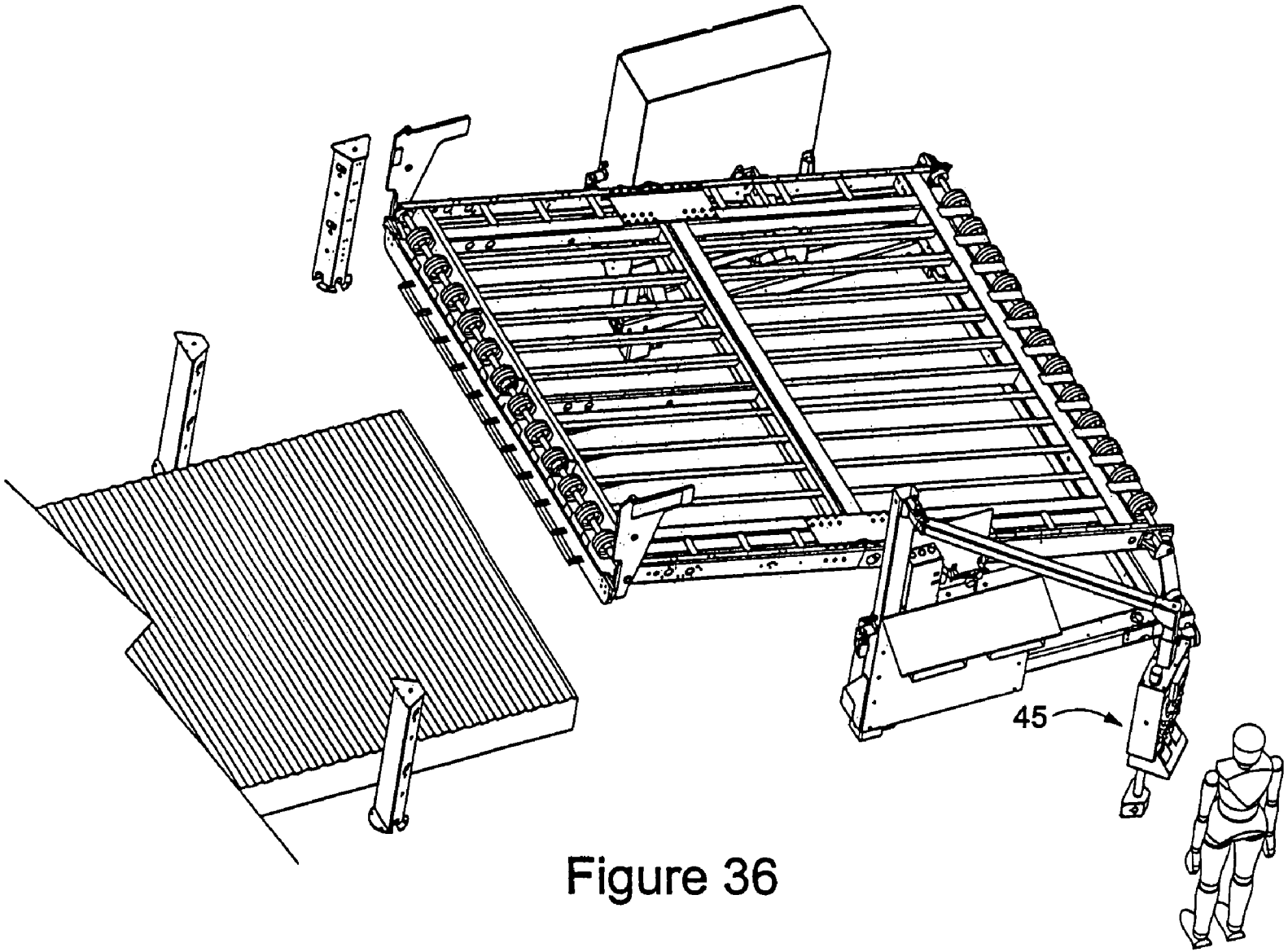
FIG. 36 is the same as FIG. 35 but with the boom moved out of the way.

The remote control means 35 is connected to the movable part of the boom 37 which in turn is swivelly attached to or adjacent to the sheet stacker 2, 2'. This give the operator the ability to move the moveable part 37 of boom 36 from the boom in position location 44 to the boom out of position location 45 as shown in FIG. 36. From this illustration, we can see how the operator does not have any post in his/her way. Also, there are often other controls on the remote control means 35 that are better adjusted when the operator is in this boom out of position location 45.

By mounting one of the optical repeating nodes 24' to the bottom of the remote control means 35, which is operably connected to the movable part of the boom 37. The resulting configuration provides a completed light guard perimeter 21 when the boom 36 is at the boom in position location 44, while also effectively eliminating the possibility of the light guard control circuit 85 being activated when the remote control means 35 is swiveled to the boom out of position location 45. This works well with the design intent of only letting the operator 30 activate the light guard control circuit 85 when the boom 36 is in the boom in position location 44.

In the preferred embodiment there is also a boom in position sensor 48, shown in FIG. 35, mounted near the elbow of the boom 36. This allows the basic LCS system control means 15,15' to make sure the remote control means 35 is properly positioned before allowing the deck down enabled button to enable the variable pinch point gap 9,9' to decrease.

In the preferred embodiment there is also an operator position sensor 47, shown in FIG. 35 that makes sure the operator 30 is standing in front of the remote control means 35 as not to be able to activate the light guard control circuit 85 from within the light guard perimeter 21.

The light guard means 27 presents the challenge when building full stacks 6' because of the need to eventually convey the completed full stacks 6' from within the light guard perimeter 21 to outside the light guard perimeter 21 on the conveying sheet removal system 7,7'. A technique exists called 'muting' by which the light beam blockage is 'ignored' by the control means when the control means 'thinks' the material is exiting through the light beams such that the light beam then automatically becomes active after the control means 'thinks' the material has successfully exited. This technique is considered inadequate for the sheet stacker 2 application since it is possible for an operator to enter the light guard perimeter 21 at the same time the full stack 6' is blocking light beams 20, 20' resulting in the operator being able to go undetected from the outside to the inside of the light guard perimeter 21.

This invention solves the problem of transporting the full stacks 6' from inside to outside the light guard perimeter 21 by configuring the light guard means 27 in a relative fashion to the conveying sheet removal system 7,7' such that it naturally works with the operators 30 work habits to minimize the impact of needing to press a light guard activation button in order to latch the light guard circuit 85 to an active state after the full stack 6' has reset the light guard circuit 85 to a deactivated state.

Figure 37:
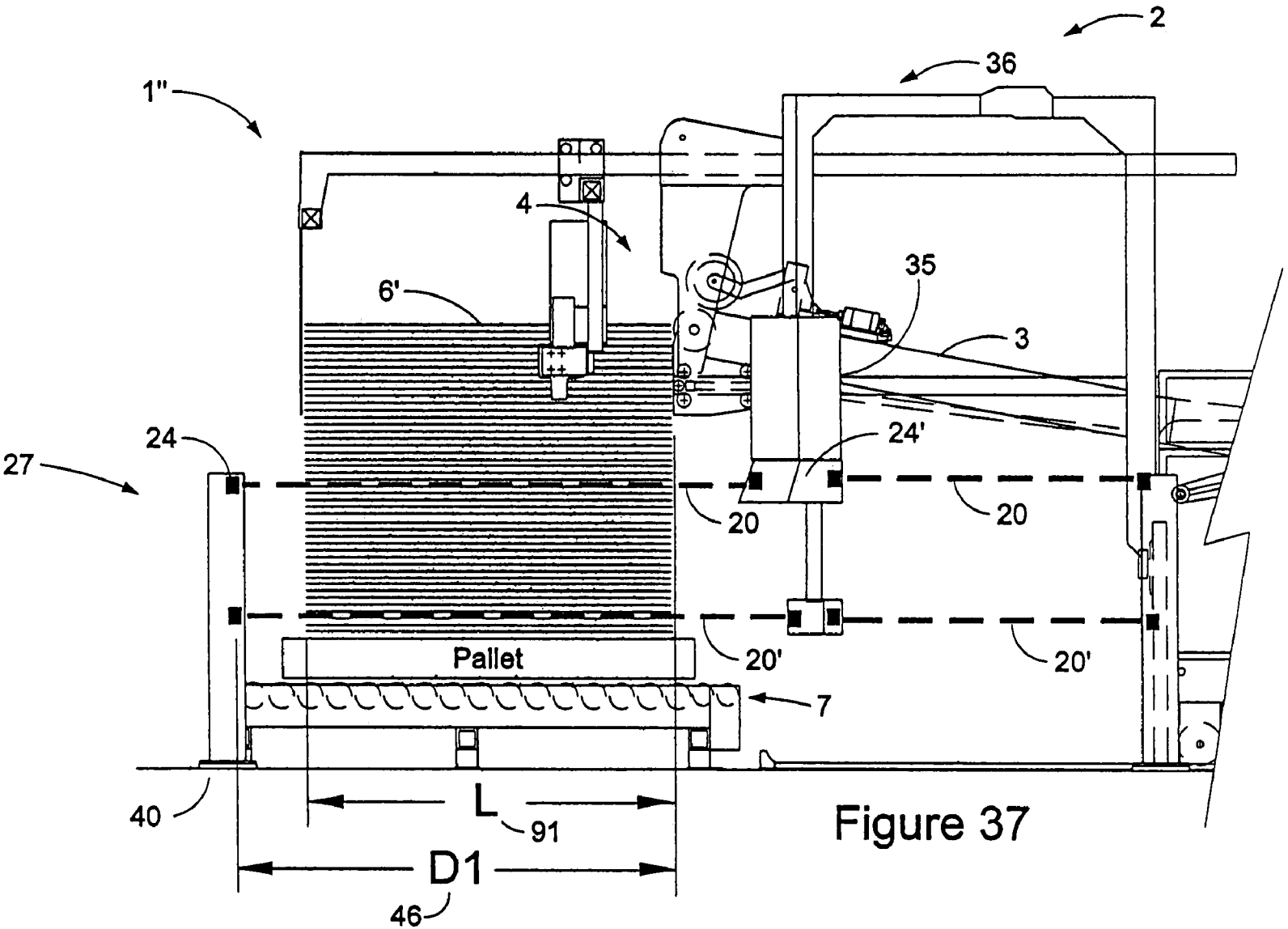
FIG. 37 is a layout showing a typical installation configuration of a light guard system in which the full stack 6' is transported from within the light guard perimeter 21 to outside the light guard system before the impending deck down cycle 56" is initiated.

FIG. 37 shows a standard configuring of the light guard means 27 in a relative fashion to the conveying sheet removal system 7. The important parameter is the distance D1 46 which is the distance from the face of the discharge end 4 of the stacking deck 3 where the full stack 6' is being built to the location where the light beams 20", 20'" cross over the conveying sheet removal system 7. The light beams 20", 20'" are the upper and lower beams in the preferred embodiment created by optical repeating nodes 24 positioned at station locations 40,41 shown in FIG. 35. In the configuration shown in FIG. 37, there is no pallet and/or dunnage inserting system 95. As a result, the operator 30 is typically required to manually place the pallet 51 and/or dunnage 50 every time the full stack 6' is transported an adequate distance downstream on to the conveying sheet removal system 7 and before the stacking deck 3 makes the deck down cycle 56", referred to in FIG. 13 for typical load change cycle 56 sequence. As a result, it is natural for the parameter D1 46 to be somewhat longer than the length L 91 of the largest full stack 6' size so the light guard perimeter 21 is not blocked while full stack 6' is being built, however, the parameter D1 46 should allow the full stack 6' to block and exit the light guard perimeter 21 in short order during the load ejection 56' allowing the operator 30 to also cross the light guard perimeter 21 and place the pallet 51 and/or dunnage 50 before the associated deck down cycle 56" begins. As a result, the operator 30 and the full stack 6' are both breaking the light guard perimeter at approximately the same time, and since the operator 30 is in the vicinity of the remote control means 35, he/she can easily press a light guard activation button 71 in order to latch the light guard circuit 85 to an active state.

Figure 38:
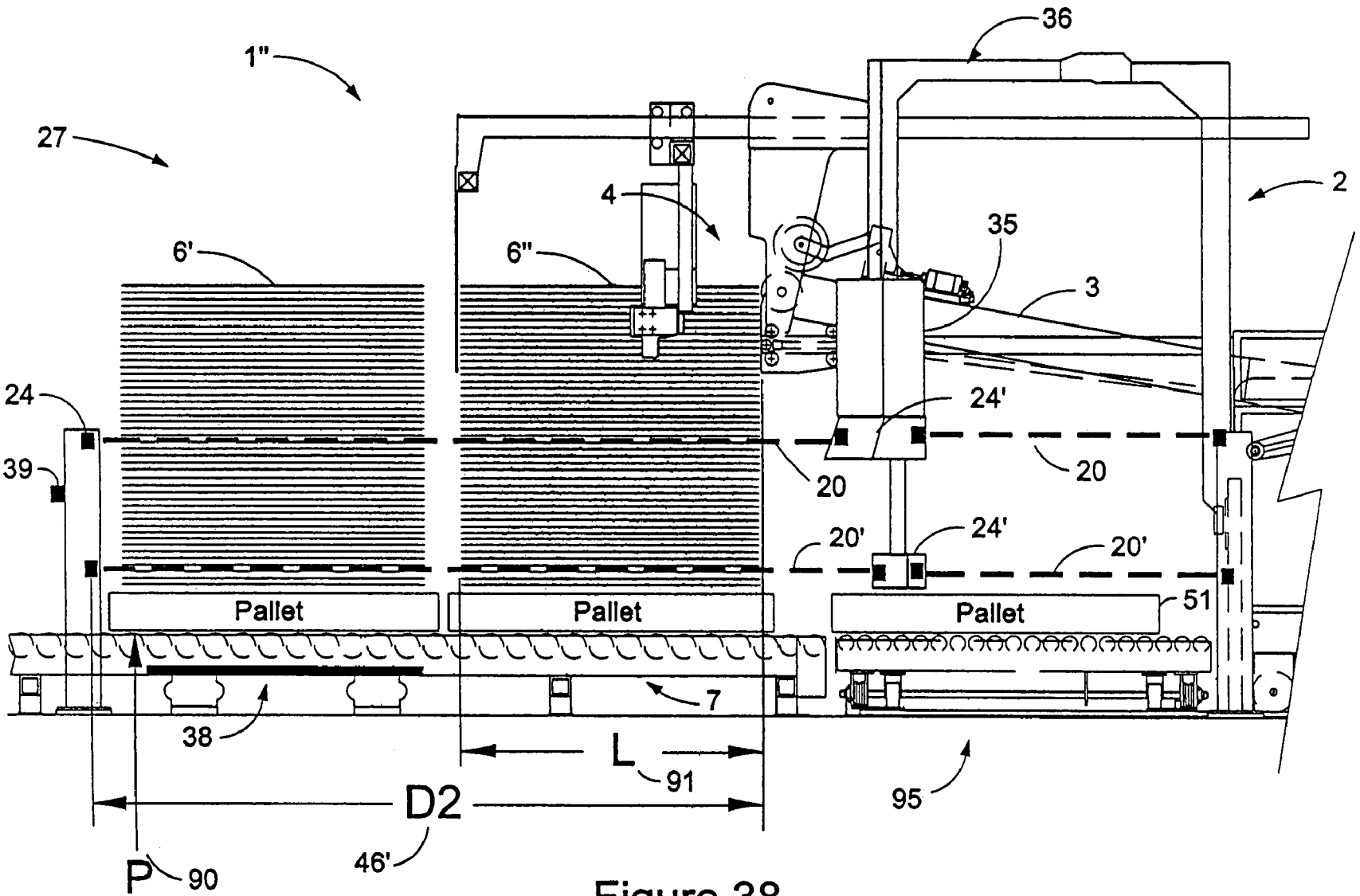
FIG. 38 is a layout showing a typical installation configuration of a light guard system configured to perform a synchronized discharge in which the full stack 6' is transported in such a way that the full stack 6' stays within the light guard perimeter 21 and allows the deck down cycle 56" to be completed before either manually or automatically being release for further transport from inside the light guard perimeter 21 to outside the light guard perimeter 21.

This invention includes a configuration of the light guard means 27 to allow for a common production line configuration that includes a pallets and/or dunnage inserter system 95 similar to the one illustrated in FIG. 38. When a pallets and/or dunnage inserter system 95 exist, the operator 30 has the luxury of not having to be present at the discharge end 4 or the stacking deck 3 during any part of the load change cycle 56. This is because the pallet 51 and/or dunnage 50 can be placed on the inserter system 95 during the time while the full stack 6' is being built. During the load change cycle 56 the pallets and/or dunnage inserter system 95 automatically indexes the pallet 51 and/or dunnage 50 during the load ejection cycle 56' in such a way as to properly position the pallet 51 and/or dunnage 50 to receive the next full stack 6" to be created. If the light beams 20", 20'" were to cross over the conveying sheet removal system 7 at the distance D1 46, the operator 30 would be required at the remote control means 35 to press a light guard activation button 71 in order to latch the light guard circuit 85 to an active state.

Figure 39:
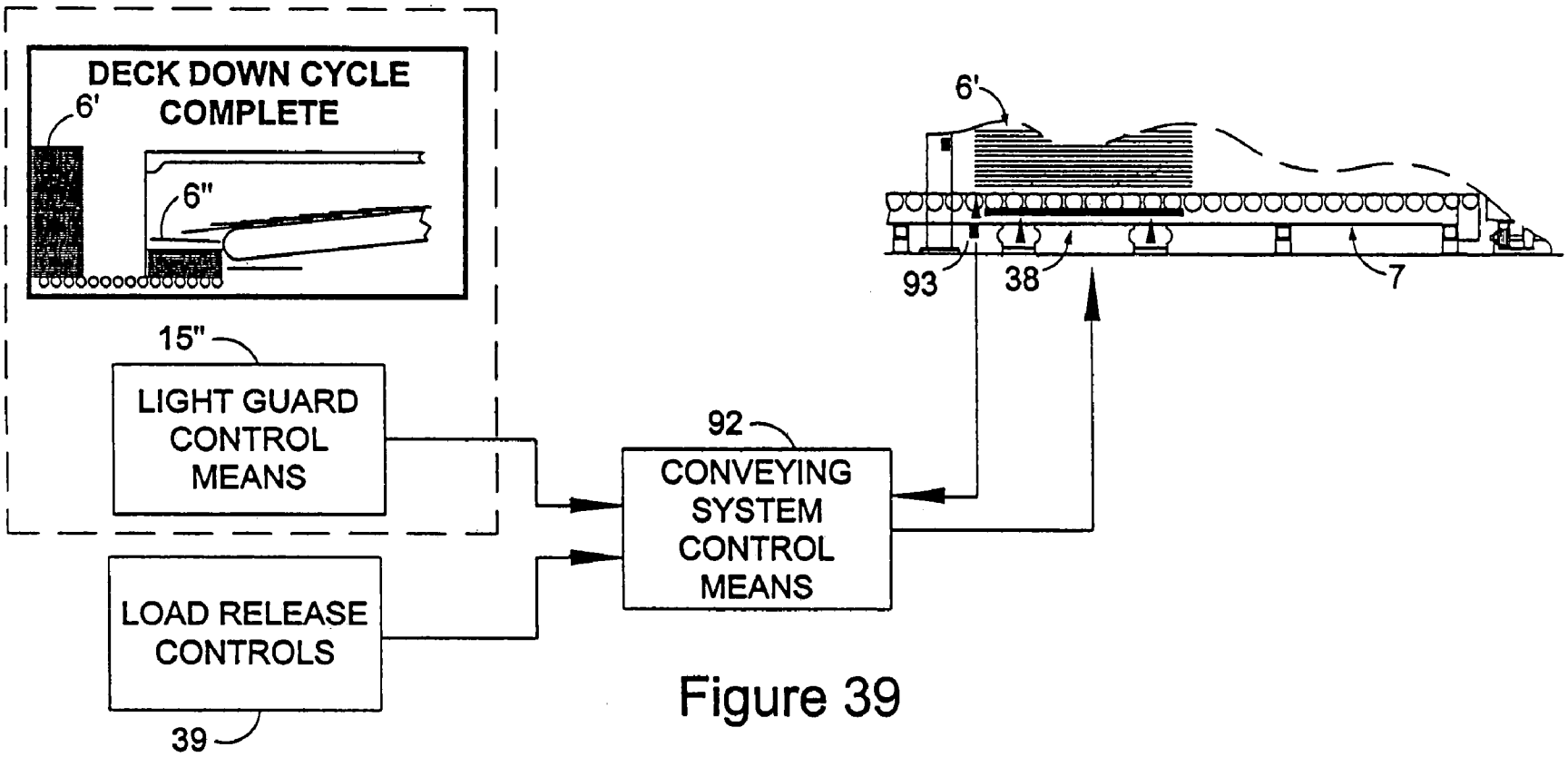
FIG. 39 is a conveying system control means 92 represented in schematic form

FIGS. 38 and 39 illustrate the solution to this problem. The light beams 20", 20'" that cross over the conveying sheet removal system 7 are moved downstream to the distance D2 46' which is the distance from the face of the discharge end 4 of the stacking deck 3 where the full stack 6' is being built. The distance D2 46' is somewhat longer than twice the longest length L 91 of the full stacks 6' that are planned for production on sheet stacker 2. This distance D2 46' allows for completed full stack 6' to be transported during the load ejection cycle 56' with its leading edge to stop at approximate location P 90 using conveying system control means 92, which is operably connect to a travel limit control means 38. Since the complete full stack 6' is still within the light guard perimeter 21, the latch light guard circuit 85 may remain active and the deck down cycle 56" can be completed without the need for operator 30 attention.

Upon completion of the deck down cycle 56", the next new full stack 6" begins to be built, at which point, the operator has two options for transporting the complete full stack 6' from inside to outside the light guard perimeter 21.

The conveying system control means 92 may simply wait for the operator 30 to press a load release control 39 at which point the conveying system control means 92 which is operably connected to a travel limit control means 38 releases new full stack 6' for transport downstream. Alternatively, the conveying system control means 92 may be set to a mode that allows the light guarded LCS system control means 15",15'" to operably signal the conveying system control means 92 when the deck down cycle 56" has been completed which then will automatically release new full stack 6' for transport downstream.

FIG. 39 illustrates in schematic form the functional relationship of conveying system control means 92. There are many well known ways to implement travel limit control means 38 such that complete full stack 6' stops at location P 90. One common method is to apply a braking section to the rollers integrated into the conveying sheet removal system 7. Typically, a feedback sensor, full stack at position P sensor 93 is connected to conveying system control means 92. The two optional release signals are also shown in FIG. 39. The one coming from the manual activated load release control 39 and the other from light guarded LCS system control means 15", 15'", which can monitor the position of the stacking deck 3. In the preferred embodiment, the conveying system control means 92 would include a selectable mode setting to allow the operator 30 to change release modes depending on the current orders being run in production.

Figure 40:
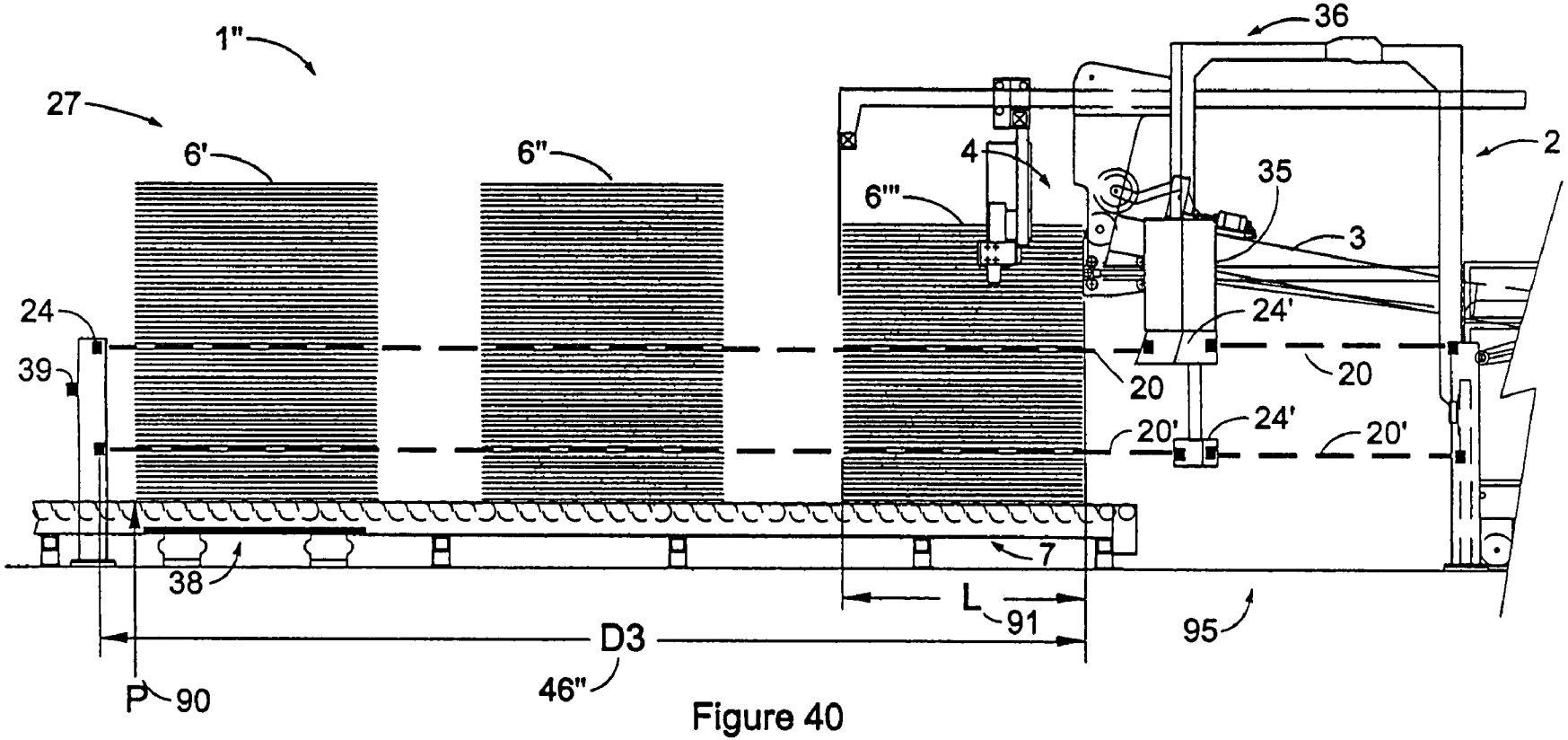
FIG. 40 is a layout showing a typical installation configuration of a light guard system configured to perform a synchronized discharge in which multiple full stacks 6',6" are transported in such a way that the full stacks stays within the light guard system and allows multiple deck down cycles 56" to be completed before either manually or automatically being release for further transport from inside the light guard perimeter 21 to outside the light guard perimeter 21.

A similar but alternate configuration of the system shown in FIG. 38 is shown in FIG. 40. The light beams 20", 20'" that cross over the conveying sheet removal system 7 are moved downstream to the distance D3 46" which is the distance from the face of the discharge end 4 of the stacking deck 3 where the full stack 6' is being built. The distance D3 46" is substantially longer than the longest length L 91 of the full stacks 6', 6", 6'" that are planned for production on sheet stacker 2. This distance D3 46" allows a plurality of completed full stack 6', 6" to be transported and stored within the light guard perimeter 21 making sure the leading edge of full stack 6' stops at approximate location P 90 using conveying system control means 92, which is operably connected to a travel limit control means 38. Since the complete full stacks 6', 6" are still within the light guard perimeter 21, the latch light guard circuit 85 may remain active and the deck down cycle 56" can be completed multiple times without the need for operator 30 attention. This is advantages in production line configurations where there are no pallets 51 and/or dunnage 50 required under full stacks 6', 6".

We claim:

1. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. redundant means for selectively preventing a decrease in said variable pinch point gap to reduce the chances of an operator being hurt wherein said redundant means is operatively connected to a deck down enabled switch which allows the operator to selectively prevent a decrease in said variable pinch point gap.

2. A load change safety system for a sheet stacker as described in claim 1 wherein:

a. said deck down enabled switch is located on remote control means b. said remote control means is mounted on a boom which is swivelly attached to or adjacent to said sheet stacker.

3. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. redundant means for selectively preventing a decrease in said variable pinch point gap to reduce the chances of an operator being hurt wherein said redundant means is operatively connected to an electro-optical light guard means with one or more redirections of one or more light beams to create a light guard perimeter for guarding portions of said sheet stacker and portions of said conveying sheet material removal system;

c. said electro-optical light guard means including one or more light beam transmitters and one or more light beam receivers; and d. said electro-optical light guard means including one or more optical repeating nodes using an optical receiver and an optical transmitter for creating the redirection of said light beam(s).

4. A load change safety system for a sheet stacker as described in claim 3 wherein:

a. said electro-optical light guard means can be activated by the operator using a switch located on remote control means; and b. said remote control means is mounted on a boom which is swivelly attached to or adjacent to said sheet stacker.

5. A load change safety system for a sheet stacker as described in claim 4 wherein:

a. one or more of said optical repeating nodes are mounted on the movable part of said boom as part of said light guard perimeter.

6. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. redundant means for selectively preventing a decrease in said variable pinch point gap to reduce the chances of an operator being hurt wherein said redundant means is operatively connected to an electro-optical light guard means with one or more individual light beam circuits to create a light guard perimeter for guarding portions of said sheet stacker and portions of said conveying sheet material removal system; and c. said light beam circuits consist of only a light beam transmitter and a light beam receiver.

7. A load change safety system for a sheet stacker as described in claim 6 wherein:

a. said electro-optical light guard means can be activated by the operator using a switch located on remote control means; and b. said remote control means is mounted on a boom which is swivelly attached to or adjacent to said sheet stacker.

8. A load change safety system for a sheet stacker as described in claim 7 wherein:

a. one or more of said light beam circuits are mounted on the movable part of said boom as part of said light guard perimeter.

9. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. hydraulic means for selectively preventing a decrease in said variable pinch point gap to reduce the chances of an operator being hurt wherein c. said hydraulic means would include one or more valves connected to one or more hydraulics cylinders for raising and lowering said stacking deck;

d. said hydraulic cylinder(s) are of adequate strength to provide support for said stacking deck;

e. said valve(s) may selectively and alternatively permit and prevent flow of fluid from those of said hydraulic cylinder(s) which are operating normally and have not failed, thereby resulting in rapidly preventing said variable pinch point gap from narrowing; and f. said hydraulic means is operatively connected to a deck down enabled switch which allows the operator to selectively prevent a decrease in said variable pinch point gap.

10. A load change safety system for a sheet stacker as described in claim 9 wherein:

a. said deck down enabled switch is located on remote control means; and b. said remote control means is mounted on a boom which is swivelly attached to or adjacent to said sheet stacker.

11. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. hydraulic means for selectively preventing a decrease in said variable pinch point gap to reduce the chances of an operator being hurt wherein c. said hydraulic means would include one or more valves connected to one or more hydraulics cylinders for raising and lowering said stacking deck;

d. said hydraulic cylinder(s) are of adequate strength to provide support for said stacking deck;

e. said valve(s) may selectively and alternatively permit and prevent flow of fluid from those of said hydraulic cylinder(s) which are operating normally and have not failed, thereby resulting in rapidly preventing said variable pinch point gap from narrowing;

f. said hydraulic means are operatively connected to an electro-optical light guard means with one or more redirections of one or more light beams to create a light guard perimeter for guarding portions-of said sheet stacker and portions of said conveying sheet material removal system;

g. said electro-optical light guard means including one or more light beam transmitters and one or more light beam receivers; and h. said electro-optical light guard means including one or more optical repeating nodes using an optical receiver and an optical transmitter for creating the redirection of said light beam(s).

12. A load change safety system for a sheet stacker as described in claim 11 wherein:

a. said electro-optical light guard means can be activated by the operator using a switch located on remote control means; and b. said remote control means is mounted on a boom which is swivelly attached to or adjacent to said sheet stacker.

13. A load change safety system for a sheet stacker as described in claim 12 wherein:

a. one or more of said optical repeating nodes are mounted on the movable part of said boom as part of said light guard perimeter.

14. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. hydraulic means for selectively preventing a decrease in said variable pinch point gap to reduce the chances of an operator being hurt wherein c. said hydraulic means would include one or more valves connected to one or more hydraulics cylinders for raising and lowering said stacking deck;

d. said hydraulic cylinder(s) are of adequate strength to provide support for said stacking deck;

e. said valve(s) may selectively and alternatively permit and prevent flow of fluid from those of said hydraulic cylinder(s) which are operating normally and have not failed, thereby resulting in rapidly preventing said variable pinch point gap from narrowing;

f. said hydraulic means are operatively connected to an electro-optical light guard means with one or more individual light beam circuits to create a light guard perimeter for guarding portions of said sheet stacker and portions of said conveying sheet material removal system;

g. said light beam circuits consist of only a light beam transmitter and a light beam receiver.

15. A load change safety system for a sheet stacker as described in claim 14 wherein:

a. said electro-optical light guard means can be activated by the operator using a switch located on remote control means; and b. said remote control means is mounted on a boom which is swivelly attached to or adjacent to said sheet stacker.

16. A load change safety system for a sheet stacker as described in claim 15 wherein:

a. one or more of said light beam circuits are mounted on the movable part of said boom as part of said light guard perimeter.

17. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. means for selectively preventing a decrease in said variable pinch point gap to reduce the chances of an operator being hurt wherein c. said means is operatively connected to a deck down enabled switch which allows the operator to selectively prevent a decrease in said variable pinch point gap;

d. said deck down enabled switch is located on remote control means; and e. said remote control means is mounted on a boom which is swivelly attached to or adjacent to said sheet stacker.

18. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. means for selectively preventing a decrease in said variable pinch point gap to reduce the chances of an operator being hurt wherein c. said means are operatively connected to an electro-optical light guard means with one or more redirections of one or more light beams to create a light guard perimeter for guarding portions of said sheet stacker and portions of said conveying sheet material removal system;

d. said electro-optical light guard means including one or more light beam transmitters and one or more light beam receivers; and e. said electro-optical light guard means including one or more optical repeating nodes using an optical receiver and an optical transmitter for creating the redirection of said light beam(s).

19. A load change safety system for a sheet stacker as described in claim 18 wherein:

a. said electro-optical light guard means can be activated by the operator using a switch located on remote control means; and b. said remote control means is mounted on a boom which is swivelly attached to or adjacent to said sheet stacker.

20. A load change safety system for a sheet stacker as described in claim 19 wherein:

a. one or more of said optical repeating nodes are mounted on the movable part of said boom as part of said light guard perimeter.

21. A load change safety system for a sheet stacker having a stacking deck formed with a discharge end for discharging sheet material onto and building sheet stacks on a conveying sheet material removal system formed with a receiving means comprising:

a. a variable pinch point gap formed by relative motion between said discharge end of said stacking deck of said sheet stacker and said receiving means of said conveying sheet material removal system; and b. means for selectively preventing a decrease in said variable pinch point gap to reduce the chances of an operator being hurt wherein c. said means are operatively connected to an electro-optical light guard means with one or more individual light beam circuits to create a light guard perimeter for guarding portions of said sheet stacker and portions of said conveying sheet material removal system;

d. said light beam circuits consist of only a light beam transmitter and a light beam receiver.

22. A load change safety system for a sheet stacker as described in claim 21 wherein:

a. said electro-optical light guard means can be activated by the operator using a switch located on remote control means; and b. said remote control means is mounted on a boom which is swivelly attached to or adjacent to said sheet stacker.

23. A load change safety system for a sheet stacker as described in claim 22 wherein:

a. one or more of said light beam circuits are mounted on the movable part of said boom as part of said light guard perimeter.

* * * * *